US007373747B1

(12) United States Patent
Wiemer et al.

(10) Patent No.: US 7,373,747 B1
(45) Date of Patent: May 20, 2008

(54) DISPLAY SYSTEM

(75) Inventors: James A. Wiemer, Fox Point, WI (US); Richard P. Hornblad, Shorewood, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 365 days.

(21) Appl. No.: 10/938,759

(22) Filed: Sep. 9, 2004

Related U.S. Application Data

(63) Continuation-in-part of application No. 10/227,153, filed on Aug. 23, 2002, now abandoned, and a continuation-in-part of application No. 09/692,559, filed on Oct. 19, 2000, now abandoned.

(60) Provisional application No. 60/314,856, filed on Aug. 24, 2001.

(51) Int. Cl.
*G09F 7/00* (2006.01)

(52) U.S. Cl. ..... 40/605; 40/600; 40/611.01; 40/618; 40/621

(58) Field of Classification Search ..... 40/600, 40/605, 606.01, 606.17, 611.01, 618, 621, 40/624; 434/73, 413, 421
See application file for complete search history.

(56) References Cited

U.S. PATENT DOCUMENTS

| | | | | | |
|---|---|---|---|---|---|
| 1,669,308 | A | | 5/1928 | Smith | |
| 2,515,664 | A | | 7/1950 | Padgett | |
| 3,093,919 | A | | 6/1963 | Holtz | |
| 3,471,959 | A | * | 10/1969 | Seger | 40/731 |
| 3,609,934 | A | | 10/1971 | O'Carroll | |
| 3,629,756 | A | | 12/1971 | Holtz | |
| 3,786,584 | A | | 1/1974 | Holson | |
| 3,965,599 | A | | 6/1976 | Ebner | |
| 3,987,567 | A | | 10/1976 | Fritts | |
| 3,994,079 | A | | 11/1976 | Mirman | |
| 4,009,524 | A | | 3/1977 | Valentine | |
| 4,017,989 | A | * | 4/1977 | Murray | 40/731 |
| 4,177,305 | A | | 12/1979 | Feingold et al. | |
| 4,242,823 | A | | 1/1981 | Bruno | |
| 4,366,637 | A | | 1/1983 | Dechamps | |
| 4,434,900 | A | | 3/1984 | Cook | |
| 4,444,524 | A | | 4/1984 | Cook et al. | |
| 4,492,719 | A | | 1/1985 | Kanai et al. | |
| 4,497,125 | A | * | 2/1985 | Hutchinson | 40/657 |
| 4,505,061 | A | | 3/1985 | Neuburger et al. | |
| 4,603,162 | A | * | 7/1986 | Hasegawa et al. | 524/404 |
| 4,615,448 | A | | 10/1986 | Johnstonbaugh | |

(Continued)

FOREIGN PATENT DOCUMENTS

EP 311350 A2 12/1989

(Continued)

*Primary Examiner*—Gary C Hoge
(74) *Attorney, Agent, or Firm*—Foley & Lardner LLP

(57) ABSTRACT

A display system comprising a base comprising a magnetic surface and a graphic sheet comprising a substrate having a front surface and a rear surface, wherein a treatment is provided on the front surface and the rear surface. The treatment provided on the front surface comprises a graphic image and a film. The treatment provided on the rear surface comprises a magnetically receptive material comprising an ultra-violet curable compound. The magnetic surface of the base is configured to releasably attach through magnetic attraction to the magnetically receptive material of the graphic sheet.

20 Claims, 20 Drawing Sheets

U.S. PATENT DOCUMENTS

| | | | | | |
|---|---|---|---|---|---|
| 4,625,477 | A | | 12/1986 | Johnstonbaugh | |
| 4,663,874 | A | | 5/1987 | Sano et al. | |
| 4,804,582 | A | | 2/1989 | Noding et al. | |
| 4,918,879 | A | | 4/1990 | Bodurow et al. | |
| 4,942,275 | A | | 7/1990 | Addy et al. | |
| D323,715 | S | | 2/1992 | Bodurow et al. | |
| 5,138,803 | A | | 8/1992 | Grossen | |
| 5,163,241 | A | | 11/1992 | Blaeser et al. | |
| 5,172,503 | A | * | 12/1992 | Dane et al. | 40/600 |
| 5,172,504 | A | * | 12/1992 | De Maat et al. | 40/605 |
| 5,269,083 | A | * | 12/1993 | Vampatella et al. | 40/711 |
| 5,286,415 | A | | 2/1994 | Buckley et al. | |
| 5,329,717 | A | * | 7/1994 | Follis | 40/605 |
| 5,484,067 | A | | 1/1996 | Sothman | |
| 5,644,884 | A | | 7/1997 | Dobija | |
| 5,694,727 | A | | 12/1997 | Dobija | |
| 5,699,631 | A | * | 12/1997 | Tyson | 40/621 |
| 5,843,329 | A | | 12/1998 | Deetz | |
| D407,832 | S | | 4/1999 | Dobija | |
| 5,918,437 | A | | 7/1999 | Dobija | |
| 6,039,356 | A | | 3/2000 | Warther et al. | |
| 6,054,968 | A | * | 4/2000 | De Matteo | 312/7.2 |
| 6,202,377 | B1 | | 3/2001 | Krieger | |
| 6,282,828 | B1 | * | 9/2001 | Cecchetto | 40/777 |
| 6,432,520 | B2 | * | 8/2002 | Pynenburg et al. | 428/195.1 |
| 2003/0046845 | A1 | * | 3/2003 | Boddie | 40/600 |
| 2003/0056413 | A1 | | 3/2003 | Wiemer et al. | |

FOREIGN PATENT DOCUMENTS

| | | | | |
|---|---|---|---|---|
| JP | 56072062 | A | * | 6/1981 |
| WO | WO 9112600 | A1 | * | 8/1991 |

* cited by examiner

FIGURE 27
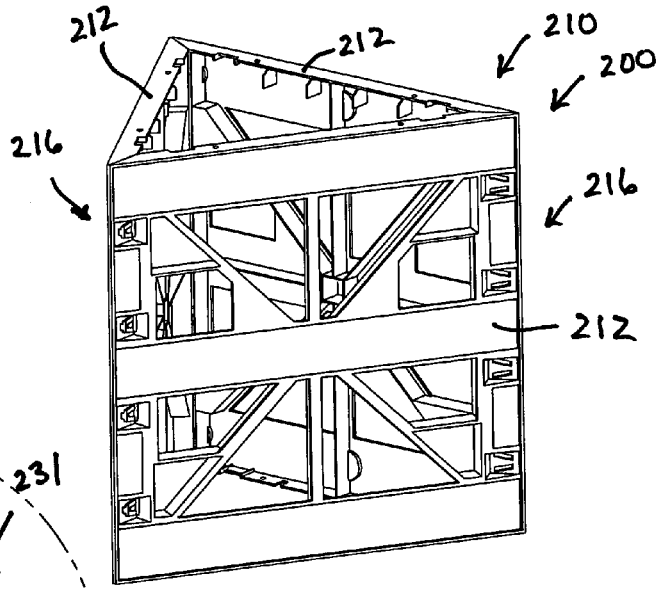
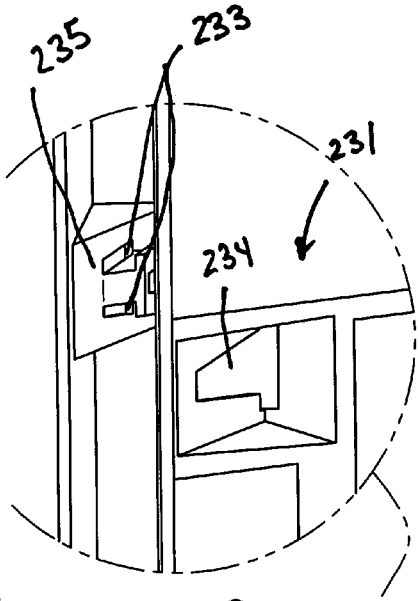
FIGURE 26B
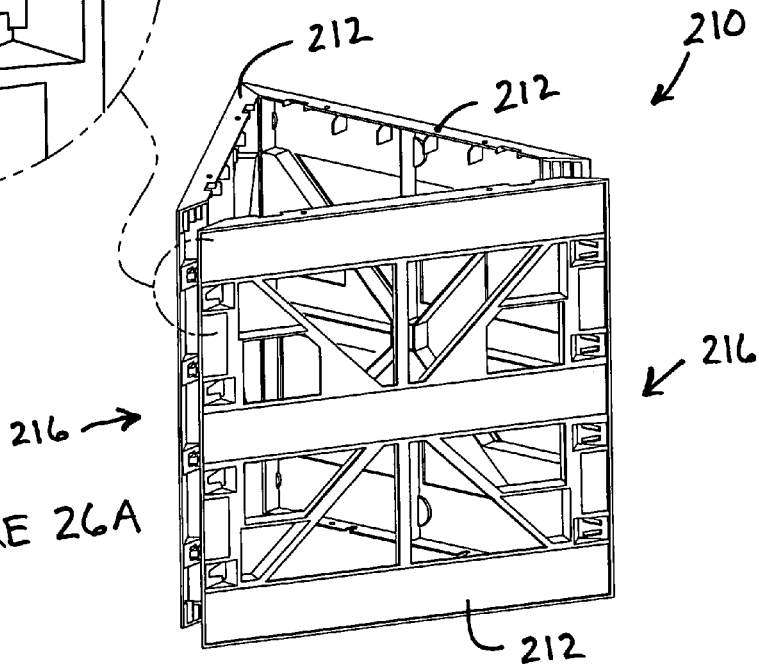
FIGURE 26A

DISPLAY SYSTEM

CROSS-REFERENCE TO RELATED APPLICATIONS

The present application is a continuation-in-part of U.S. application Ser. No. 09/692,559, filed on Oct. 19, 2000 now abandoned. The present application is also a continuation-in-part of U.S. application Ser. No. 10/227,153, filed on Aug. 23, 2002 now abandoned, which claims the benefit of U.S. Application No. 60/314,856, filed on Aug. 24, 2001.

The present application claims priority as available under 35 U.S.C. §§ 119 and 120 to the following U.S. patent Applications (which are incorporated by reference in the present Application): (a) U.S. patent application Ser. No. 09/692,559 filed Oct. 19, 2000; (b) U.S. patent application Ser. No. 10/227,153 filed on Aug. 23, 2002; and (c) U.S. Provisional Patent Application No. 60/314,856 filed on Aug. 24, 2001.

FIELD OF THE INVENTION

The present invention relates to graphic display systems and methods. In particular, the present invention relates to a graphic display system and method that utilizes magnetic attraction to support various graphic sheets.

BACKGROUND

It is known to provide for a graphic display system that may be used for displaying graphics in different settings including consumer settings such as trade shows, expos, stores, retail outlets, shops, etc. Such known systems may be used to display and present graphics in illustrating products for consumers and other interested parties.

There are many different types of graphic display systems, some of which use magnetic attraction to support graphic sheets. Many of these known systems, however, do not provide convenient and efficient means for replacing graphic sheets on an existing frame or base. For instance, some graphic systems include a magnetic graphic sheet that adheres to magnetically receptive material (e.g., metal). A common example of this type of system is a magnetic sign that is placed on a vehicle for advertising or identification purposes. This type of system has several disadvantages including that it lacks an overall frame to protect and/or align the graphic during use. Such known systems also do not typically provide a means for aligning the graphic sheet/display with other graphic sheets/displays.

It is beneficial when presenting graphics for viewing that the overall appearance of the graphic system appeal to customers and attract attention. For example, some known display systems do not provide strong and/or rigid support for graphic sheets. This supportive configuration can be an important feature for customers and retailers because it enables graphic sheets to be displayed with less sagging, deformation, and/or movement when being displayed. It is also useful to present graphic displays in a relatively neat and orderly manner. However, within fixed or limited spaces, known systems may not be configured to allow for relatively neat and orderly presentation of graphics. Such known systems do not always provide graphic displays in organized, straight, linear, and/or level arrangements. Thus, it is sometimes difficult to arrange a plurality of sheets together to form an overall graphic and/or design. Many known systems may include frames for an individual graphic sheet, but may not provide a frame that is configured to be used with other frames to create an overall system comprising individual frames and graphic sheets.

Accordingly, it would be advantageous to provide a graphic display system and method that includes a frame for supporting the graphic sheets with strong and/or rigid support. It would also be desirable to provide a graphic display system and method that includes a frame for supporting the graphic sheets in an orderly and organized fashion. Additionally, it would be desirable to provide a frame that is configured to be used with other frames in order to create displays comprising a plurality of separate graphic sheets that may be arranged to form a single design and/or graphic.

It would be advantageous to provide a system/method or the like of a type disclosed in the present application that provides any one or more of these or other advantageous features. The present invention further relates to various features and combinations of features shown and described in the disclosed embodiments.

SUMMARY

The present invention relates to a display system comprising a base comprising a magnetic surface and a graphic sheet comprising a substrate having a front surface and a rear surface, wherein a treatment is provided on the front surface and the rear surface. The treatment provided on the front surface comprises a graphic image and a film. The treatment provided on the rear surface comprises a magnetically receptive material comprising an ultra-violet curable compound. The magnetic surface of the base is configured to releasably attach through magnetic attraction to the magnetically receptive material of the graphic sheet.

The present invention also relates to a display system comprising a plurality of frames each comprising a magnetic surface, a plurality of graphic sheets each comprising a substrate having a front surface and a rear surface, wherein a treatment is provided on each front surface and each rear surface. The treatment provided on the front surfaces comprises a graphic image and a film, The treatment provided on the rear surfaces comprises a magnetically receptive material comprising an ultra-violet curable compound. The magnetic surface of each frame is configured to releasably attach through magnetic attraction to the magnetically receptive material of each graphic sheet to form an overall composite design comprising a plurality of individual graphic images.

The present invention further relates to a method of producing a display system comprising providing a base with a magnetic surface and providing a graphic sheet comprising a substrate having a front surface and a rear surface. The method comprises providing a first treatment comprising printing a graphic image on the front surface and applying a film to the front surface, providing a second treatment comprising applying a magnetically receptive material comprising an ultra-violet curable compound to the rear surface of the graphic sheet and curing the magnetically receptive material using ultra-violet light, and configuring the base so that the magnetic surface releasably attaches through magnetic attraction to the magnetically receptive material of the graphic sheet.

The present invention further relates to a display system for providing an enlarged graphic on a support surface comprising a first frame having a magnetic surface and configured to be coupled to the support surface, a first panel configured to be removably coupled to the first frame by magnetic attraction, a first graphic component provided on a front surface of the first panel and covered with a coating, a magnetically receptive material comprising an ultra-violet curable compound screened onto a rear surface of the first panel, a second frame having a magnetic surface and configured to be coupled to the support surface, a second panel configured to be removably coupled to the second frame by magnetic attraction, a second graphic component provided on a front surface of the second panel and covered with a coating, and a magnetically receptive material comprising an ultra-violet curable compound screened onto a rear surface of the second panel. The first graphic and the second graphic components are configured to provide a portion of the enlarged graphic.

BRIEF DESCRIPTION OF THE DRAWINGS

FIG. 26A is a perspective view of a display system according to an alternative embodiment.

FIG. 26B is a detailed perspective view of the display system of FIG. 26A.

FIG. 27 is a perspective view of a display system according to an alternative embodiment.

DETAILED DESCRIPTION

Figure 1:
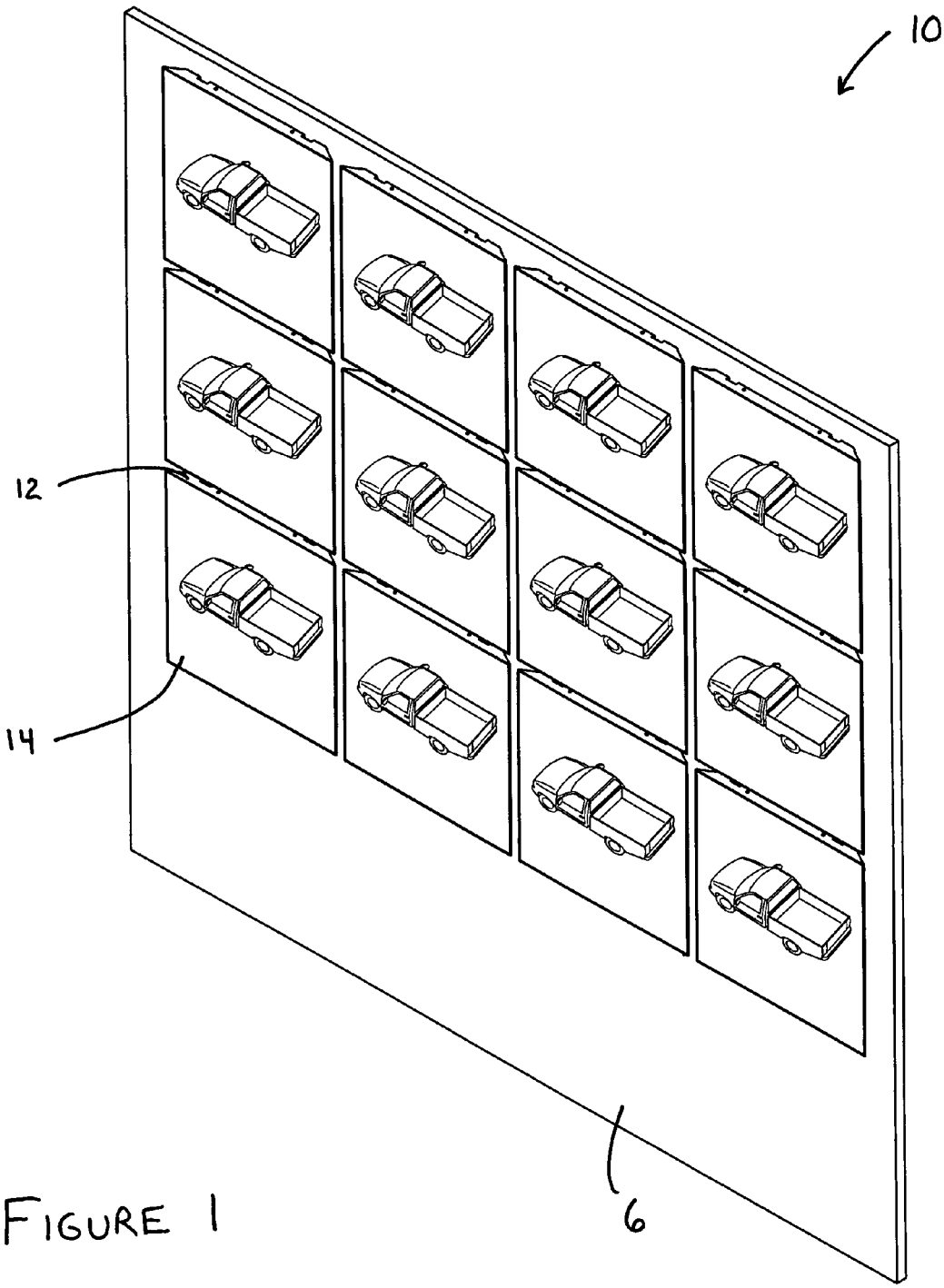
FIG. 1 is a front perspective view of a display system according to an exemplary embodiment.
Figure 2:
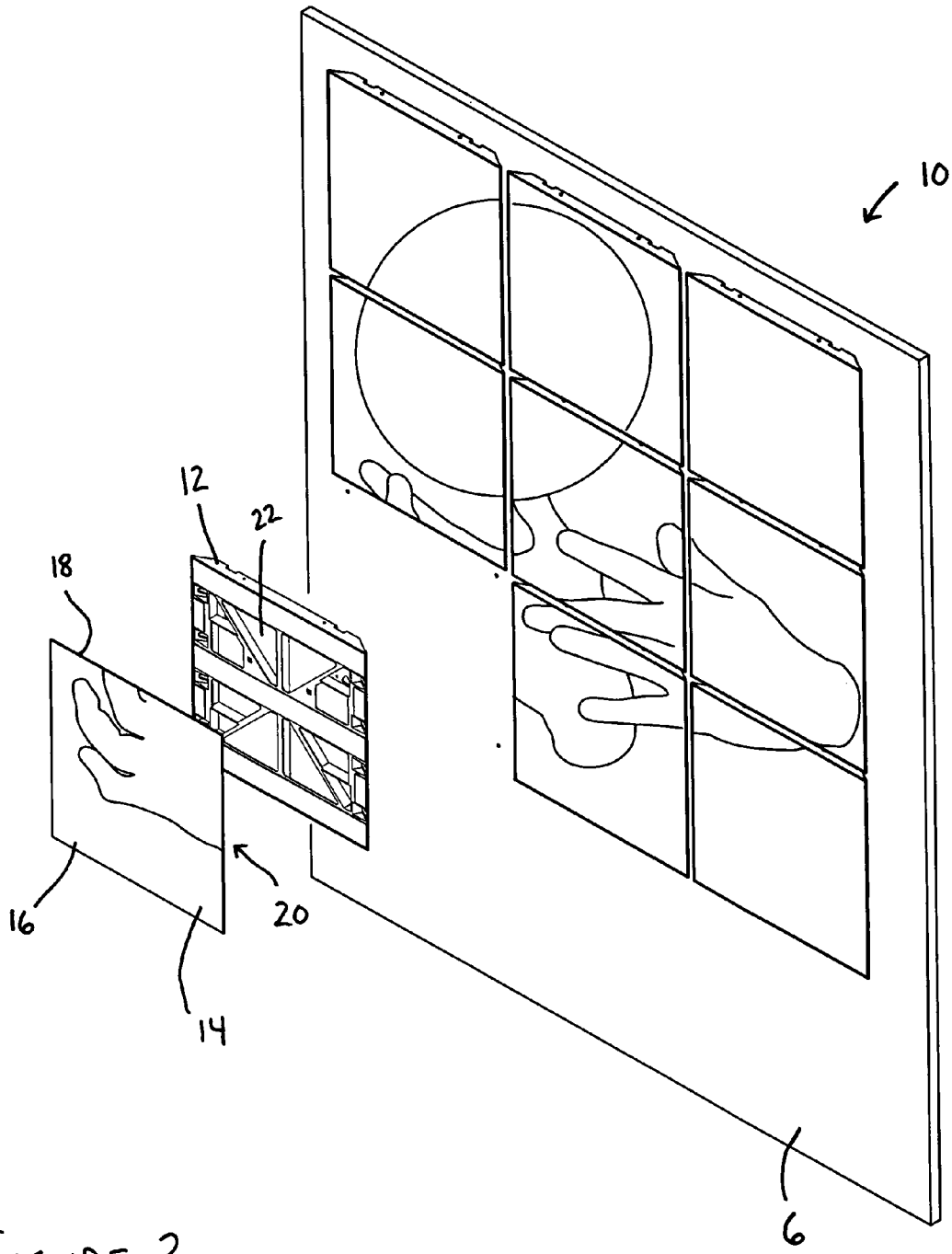
FIG. 2 is an exploded front perspective view of a display system according to an exemplary embodiment.
Figure 3:
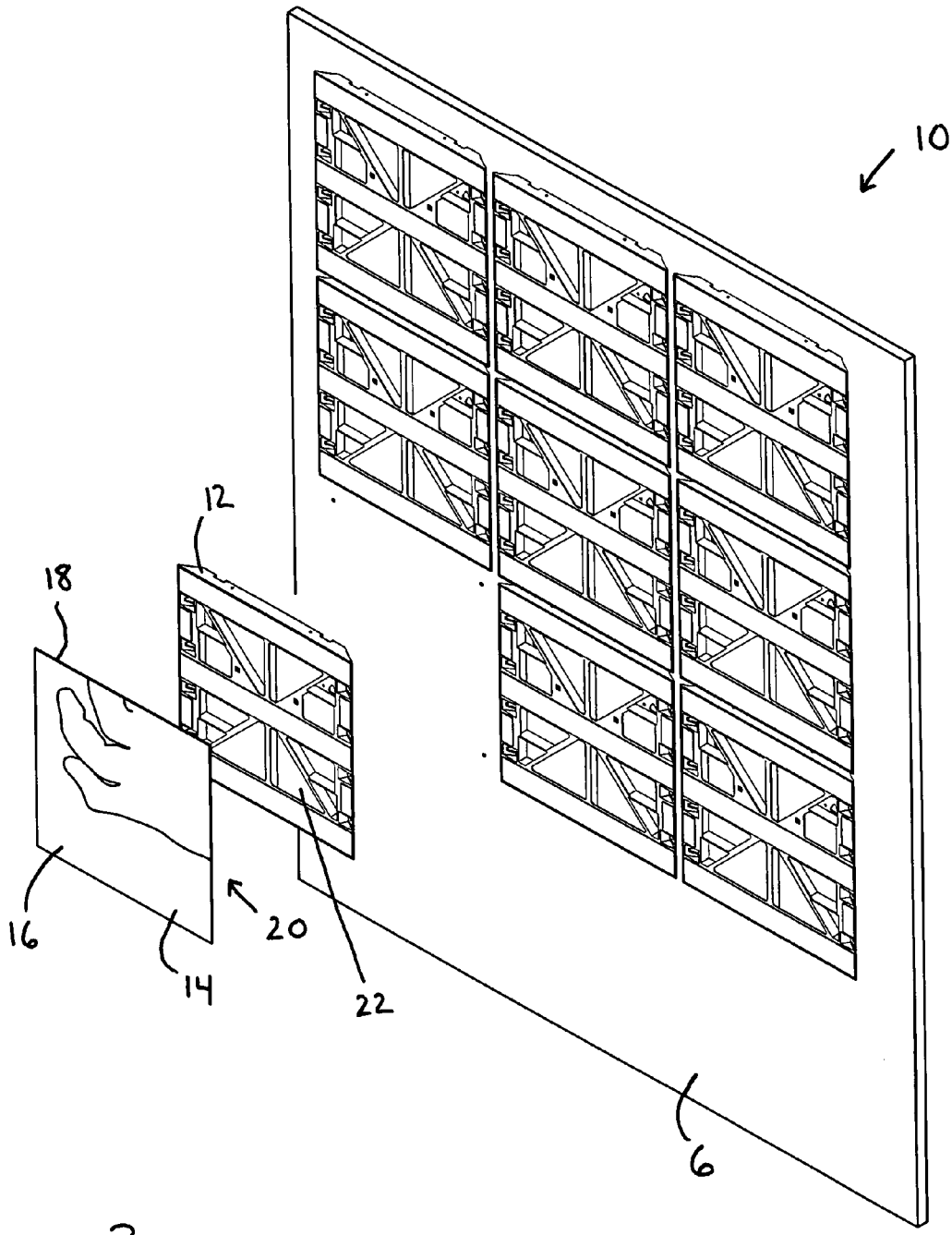
FIG. 3 is an exploded front perspective view of a display system according to an exemplary embodiment.

It is to be understood that the inventions are not limited to the details or methodology set forth in the following description or illustrated in the drawings. The inventions are capable of other embodiments or being practiced or carried out in various ways. It is also to be understood that the phraseology and terminology employed is for the purpose of description and should not be regarded as limiting.

Referring to FIGS. 1 through 9C, a graphic display system or assembly 10 is shown. System 10 comprises a base or frame 12 (e.g., a frame system or network, mounting surface, mounting structure, support structure, supports, etc.) and a panel or graphic sheet 14 (e.g., graphics, graphic, sheet, sheet to which a graphic is applied, pane, etc.) supported by frame 12. According to an exemplary embodiment, frame 12 is configured to attach to and/or be supported by a wall, a stand, a base/frame, and/or any other suitable structure (such as wall 6 shown in FIG. 6) for displaying graphic sheet 14. Frame 12 is configured for supporting and attaching to graphic sheet 14 having a graphic and/or graphic image. In general, the display system is configured to present a graphic, visual effect or other information (e.g., text, messages, visual image(s), text/pictorial combinations, etc.) to allow for the presentation and/or display of a graphic on a variety of structures or surfaces such as walls, ceilings, floors, non-vertical or non-horizontal structures, supports, etc. It may be desirable to present a large "composite" graphic (i.e., a large or enlarged overall graphic that has been broken up into several components, portions, pieces, etc.). For example, it may not be convenient to produce a large image in a single printing step or process to be supported by a single base. The display system shown in the exemplary embodiments allows for the presentation and/or display of large or enlarged graphics (as well as individual graphics) individually or comprised of segments or components supported by a single base as well as multiple bases. The display system may be used on walls to provide an overall larger image, graphic, or similar visual effect than the size of each graphic sheet used in the display system.

Figure 9A:
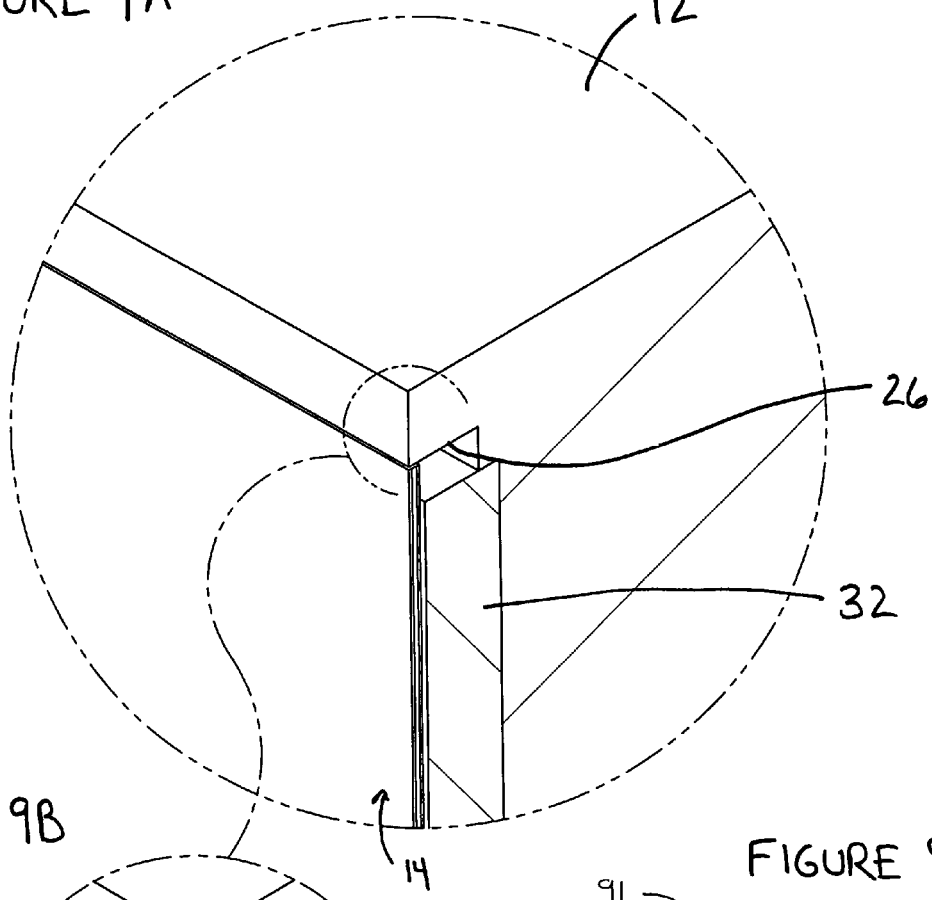
FIG. 9A is a cross-sectional view of the graphic sheet taken along line 9-9 of FIG. 7.
Figure 9B:
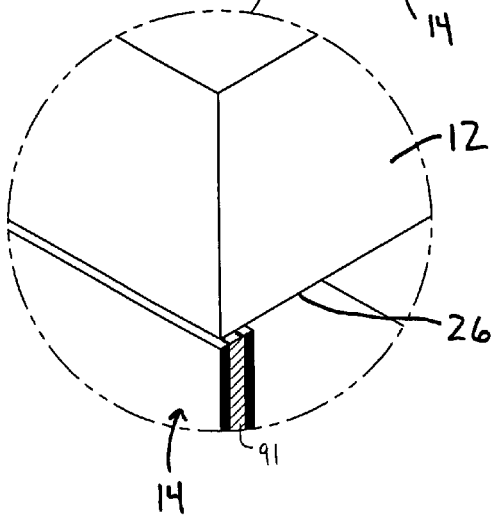
FIG. 9B is a detailed cross-sectional view of the graphic sheet of FIG. 9A.
Figure 9C:
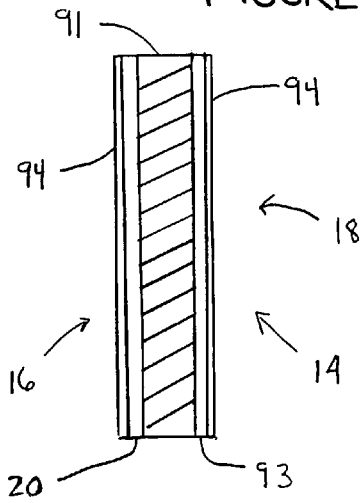
FIG. 9C is a detailed cross-sectional view of the graphic sheet of FIGS. 9A and 9B.

As shown in FIGS. 1 through 9C, graphic sheet 14 comprises a front surface 16 and a rear surface 18. As shown in FIGS. 9A through 9C, sheet 14 includes a base or substrate 91 (e.g., core, paper, cardstock, center, etc.). The substrate may be made from and/or may comprise any number of suitable materials including a cardstock material (e.g., tag-stock, photo paper, styrene, film, paper, plastics, ABS plastic, etc.), fiber, metal, composite, etc. According to an exemplary embodiment, graphic sheet 14 is flexible so that it may be rolled up when not in use. Graphic sheet 14 includes front surface 16 to which a treatment or layer is applied to and/or provided on. As shown in FIGS. 9A through 9C, the treatment includes a graphic image 20 (e.g., graphic, information, text, visual display, visual effect, artwork, photographs, pictures, simulated surface finishes, graphics, etc.) printed on one side of sheet 14 (e.g., front surface 16). The treatment includes a film 94 (e.g., varnish material, coating, surface, treatment, aqueous material, etc.). According to a preferred embodiment, a graphic image is printed on the front surface and covered with a clear varnish material. According to an exemplary embodiment, graphic sheet 14 may be removed from frame 12 and replaced with a structurally identical graphic sheet having a graphic image. Thus, a user may select a particular graphic sheet having a desired graphic image from a plurality of graphic sheets for a particular occasion. According to an exemplary embodiment, the graphic provided on an individual graphic image is a portion or component of an overall larger image. According to another exemplary embodiment, the graphic sheet is a portion or component of an overall larger image or graphic. According to an alternative embodiment, a graphic may be provided on an individual graphic sheet or by combination of two or more graphic sheet. According to another alternative embodiment, the graphic sheet may be blank, allow for additional marking or placement of graphics, etc. According to an exemplary embodiment, a graphic may be provided on either an individual graphic sheet or in or by some combination of two or more graphic sheets.

Figure 4:
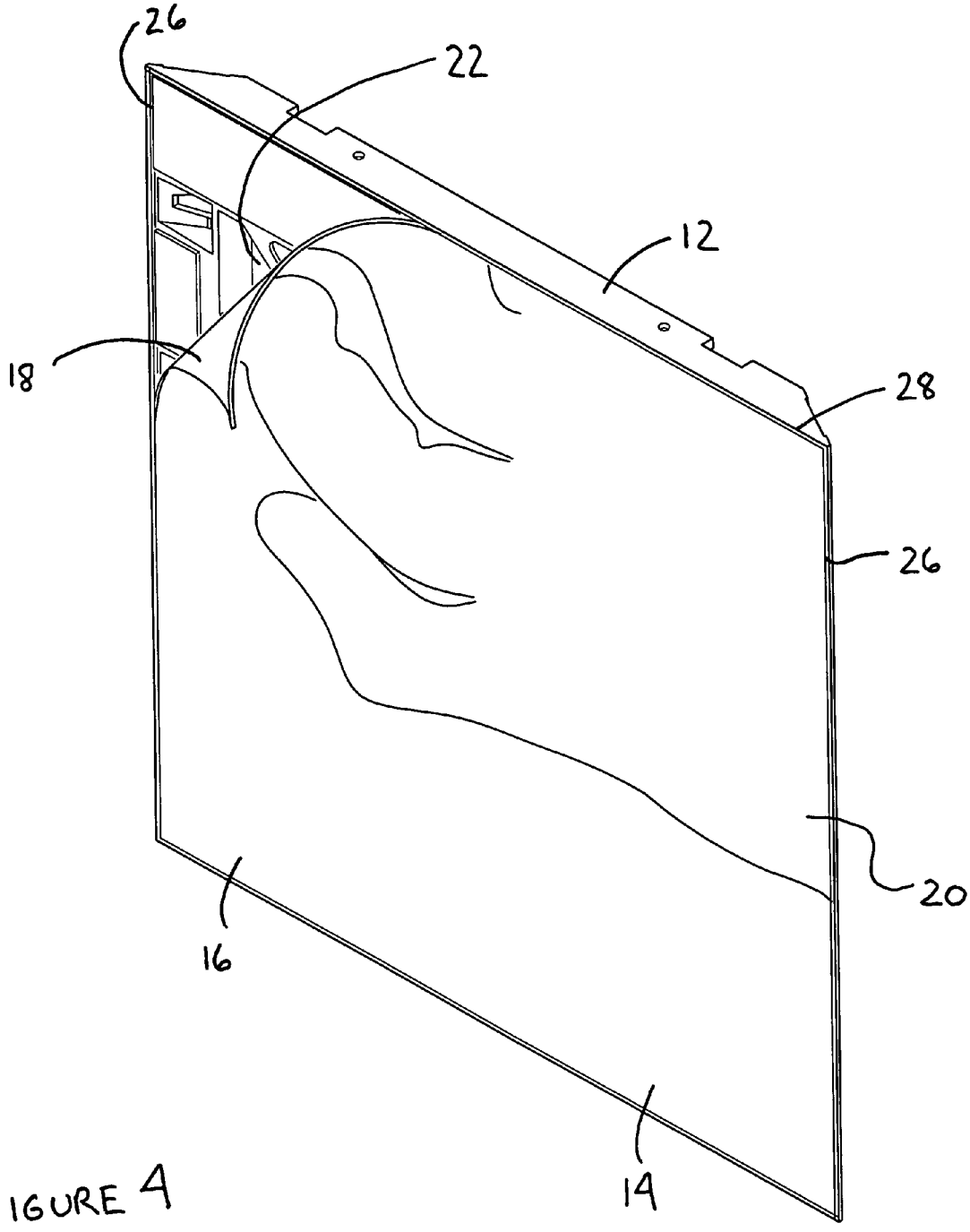
FIG. 4 is a front perspective view of a display system according to an exemplary embodiment.
Figure 5:
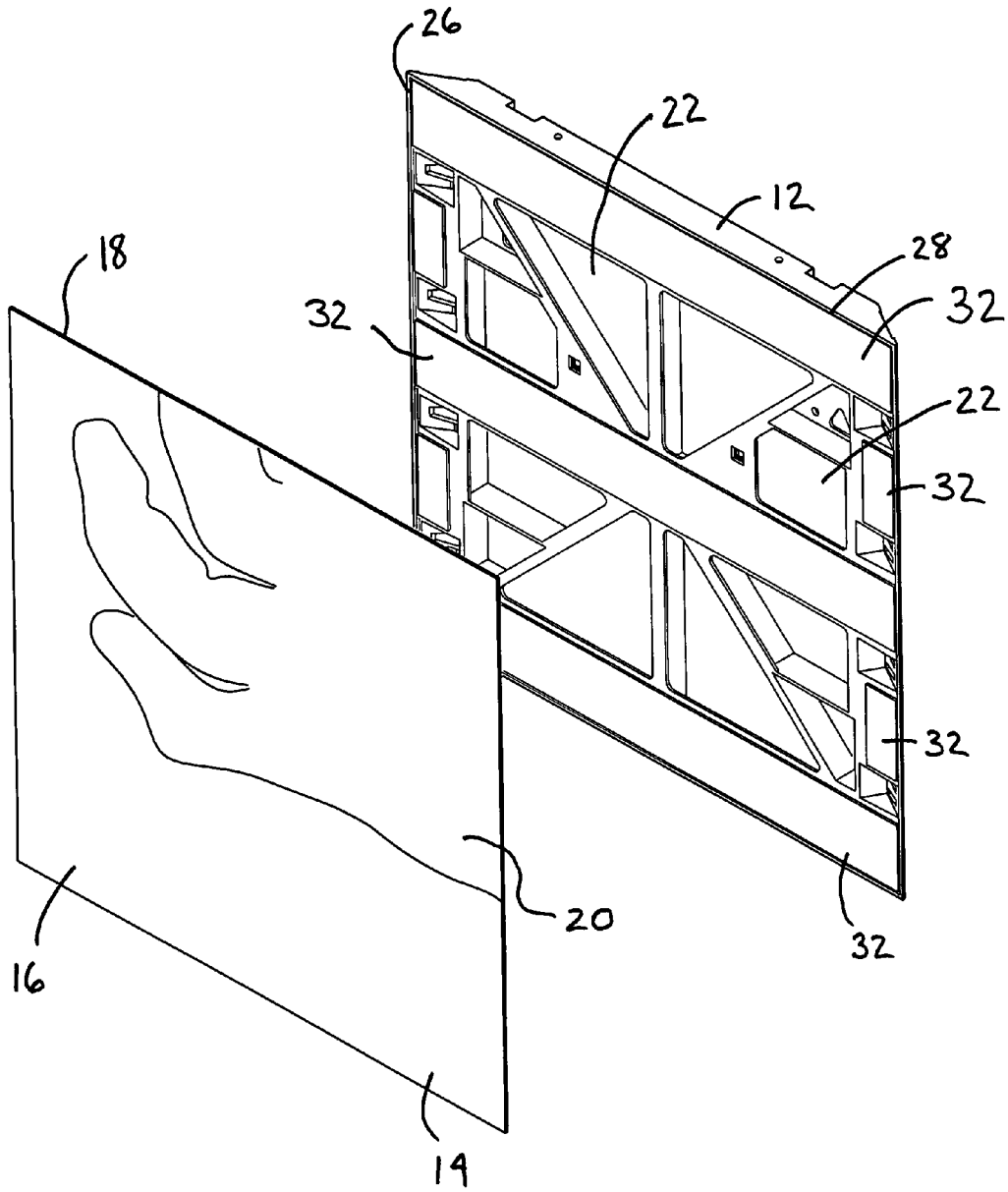
FIG. 5 is an exploded front view of a display system according to an exemplary embodiment.
Figure 6:
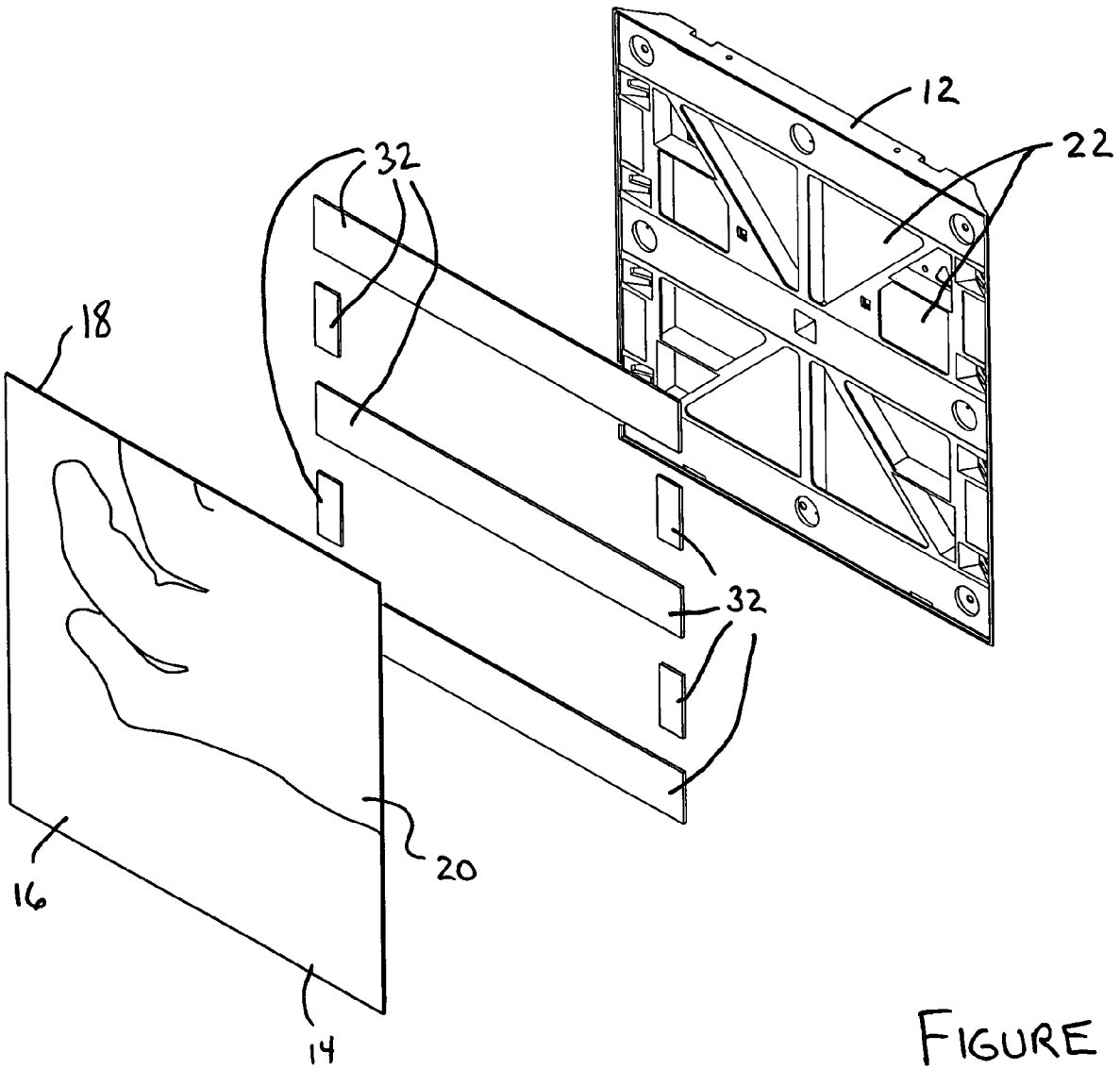
FIG. 6 is an exploded front perspective view of a display system according to an exemplary embodiment.
Figure 8:
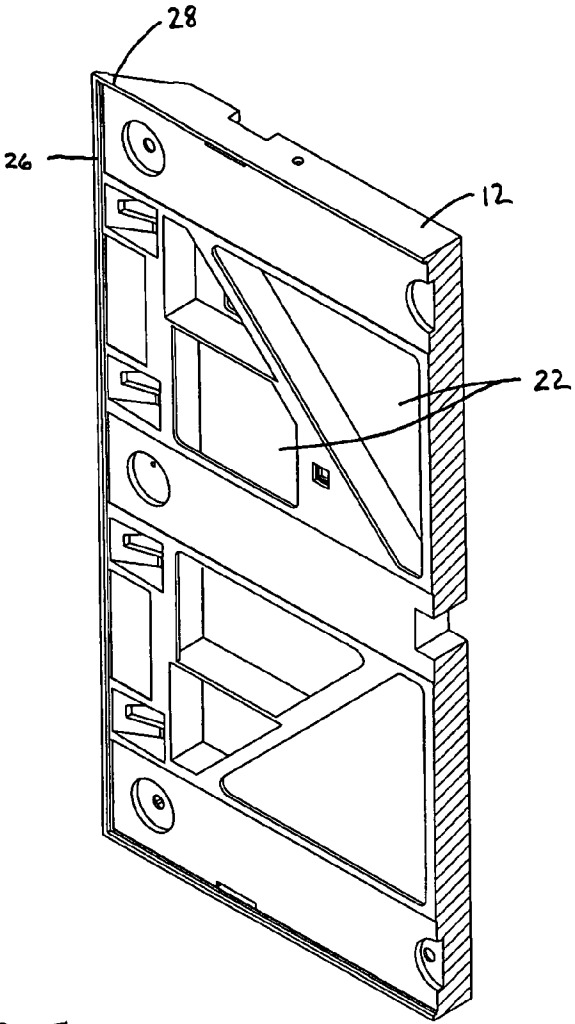
FIG. 8 is a cross-sectional view of a frame of a display system according to an exemplary embodiment.
Figure 7:
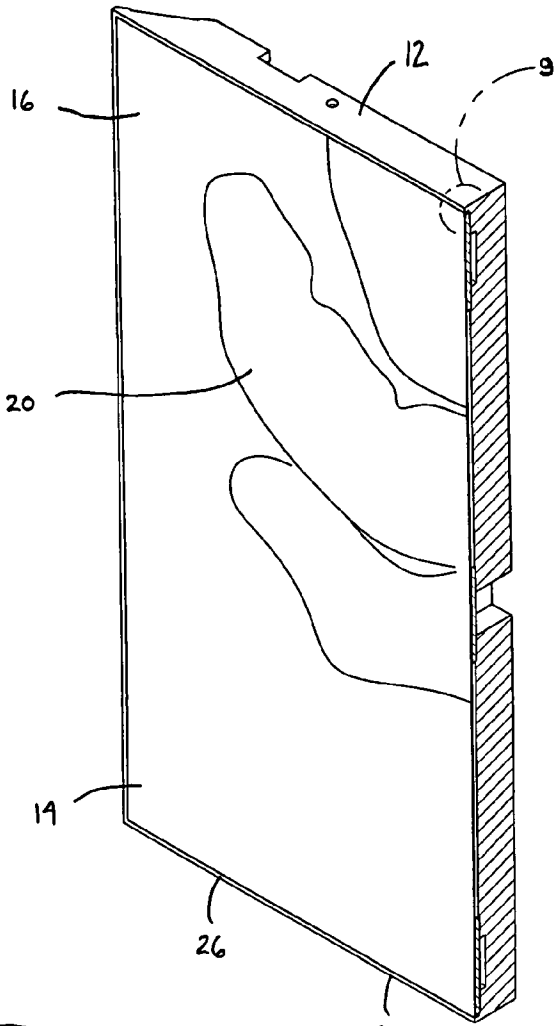
FIG. 7 is a cross-sectional view of the display system of FIG. 1.
Figure 12:
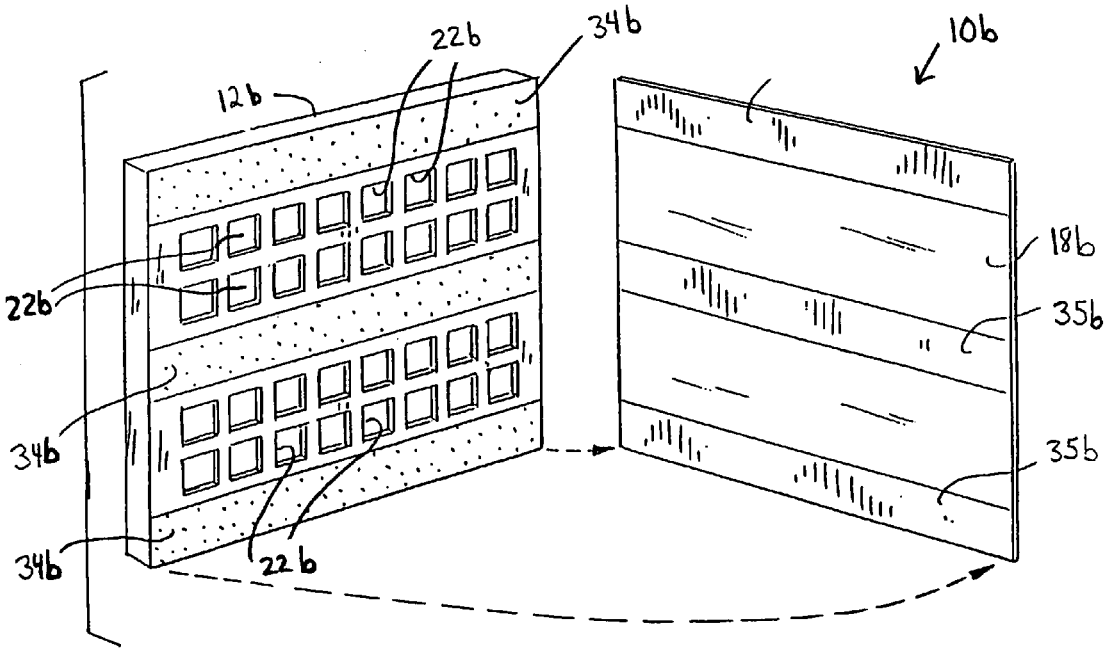
FIG. 12 is a front perspective view of a display system according to an alternative embodiment.
Figure 14:
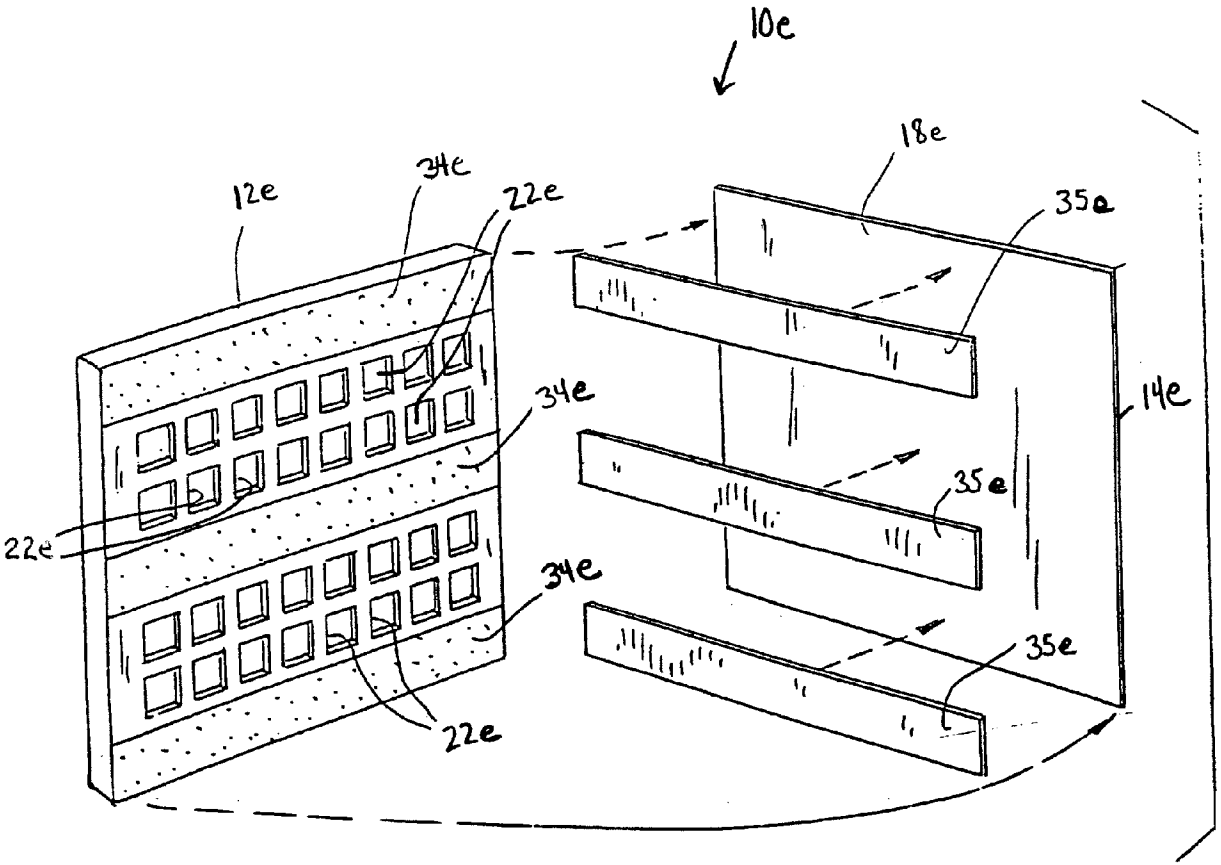
FIG. 14 is an exploded view of the display system according to an alternative embodiment.
Figure 15:
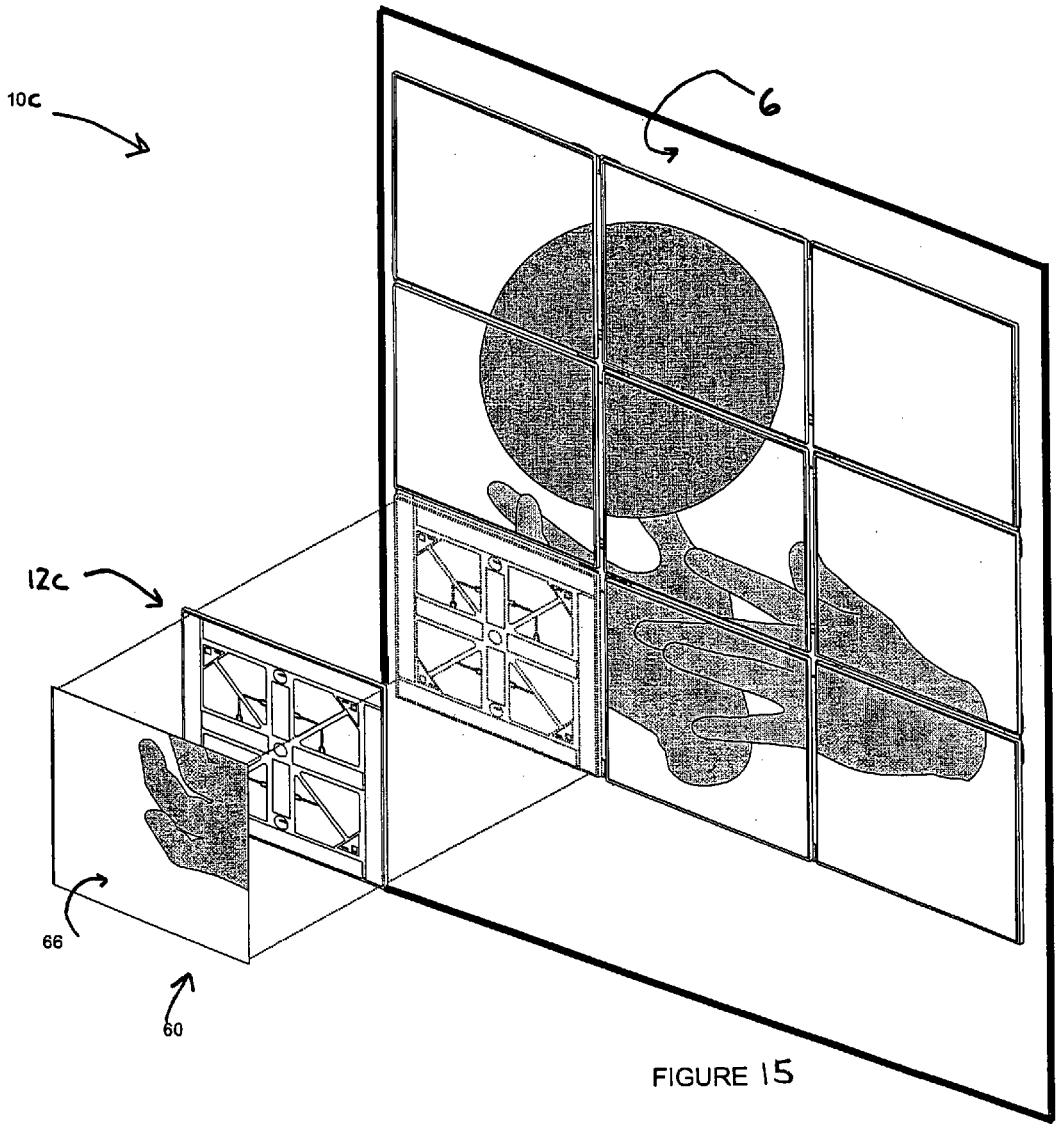
FIG. 15 is a perspective view of a display system according to an exemplary embodiment.

According to an exemplary embodiment, graphic sheet 14 includes rear surface 18 to which a treatment or layer is applied to and/or provided on. Referring to FIGS. 4, 5 and 6, rear surface 18 of graphic sheet 14 is shown having magnetic receptive material applied thereto. Referring to FIGS. 9A through 9C, magnetically receptive material 93 is applied to and/or provided on one side of sheet 14 (e.g., rear surface 18). The treatment includes a film 94 (e.g., varnish material, coating, surface, treatment, aqueous material, etc.). According to a preferred embodiment, the magnetically receptive material is applied to and/or provided on rear surface of sheet 14 and a film is not used or applied to the rear surface of the sheet. According to an exemplary embodiment, the magnetic receptive material is applied to a substantial portion of rear surface 18 (e.g., the magnetic receptive material may cover the entire rear surface). According to alternative embodiments, the magnetic receptive material may cover portions and/or strips of the rear surface. For example, FIGS. 12 and 14 shows strips 35*b*, 35*e* (e.g., finite and/or discrete portions) comprising magnetic receptive material applied to the rear surface of the graphic sheet. The magnetic receptive material may be applied according to various alternative embodiments (e.g., in layers, different textures, different densities, patterns, etc.).

According to a preferred embodiment shown in FIGS. 1 through 9C, the magnetic receptive material is applied to rear surface 18 of graphic sheet 14 by a silk screening process. According to an exemplary embodiment, the magnetic receptive material is a metallic, magnetic compound which includes a graphite powder mixed with a clear carrier. The clear carrier is a water-based slurry and the resulting magnetic receptive material is provided in ink form to facilitate the silk screening process. According to an exemplary embodiment, the magnetic receptive material is an ultra-violet curable screen printing ink. According to an exemplary embodiment, the ultra-violet curable material comprises at least one of acrylate ester, a ketone initiator mixture, a synergist, pigments, iron and any combinations thereof. The boiling range is approximately greater than 150 degrees C., the density is about 9.0 to 10.6 lbs/gallon, the vapor density is heavier than air, and the evaporation rate is slower than diethyl ether. The ultra-violet curable material includes photo-initiators that absorb ultra-violet energy from the ultra-violet light source. The energy causes the photo-initiator to fragment into reactive materials (e.g., monomers and oligimers) that in turn begin a polymerization process which converts the liquid ink film into a solid ink film. Colored pigments may be replaced by iron particles to provide magnetic receptive qualities for the ink film. According to a particularly preferred embodiment, the ink is commercially available as an ultra-violet curable screen printing ink from Polymeric Imaging, Inc. of North Kansas City, Mo. According to other exemplary embodiments, various other suitable ink films and ultra-violet curable materials may be used.

According to a preferred embodiment shown in FIGS. 1 through 9C, frame 12 is constructed from a plastic material (e.g., injection molded plastic). According to various exemplary embodiments, the frame may be constructed from a variety of materials, such as aluminum, other metals, metal alloys, plastics, polymers, styrene, vacuum formed plastics, injection molded plastics, composites, etc. According to an exemplary embodiment, the frame has a rectangular shape approximately one to three feet by one to three feet in size. According to various alternative embodiments, the frame may have a variety of sizes (e.g., 14 inches×14 inches, 16 inches×24 inches, 18 inches×18 inches, 24 inches×24 inches, etc.) and a variety of shapes such as square, triangular, diamond, hexagonal, etc.

Frame 12 is preferably substantially rigid to deter bending and/or deflection. Frame 12 is preferably configured to be removably mounted to a structure (e.g., wall, post, pole, base, frame, etc.). According to an exemplary embodiment, frame 12 includes a border 26 that extends around perimeter 28 of frame 12. Border 26 may be any suitable size and is intended to align graphic sheet 14 when attached to frame 12. The border is configured to deter an attached graphic sheet from moving or sliding once attached to the frame. According to an exemplary embodiment, the border is configured to protect and deter a graphic sheet from being removed by bumping, brushing, and/or other disruptions to the frame.

Figure 10:
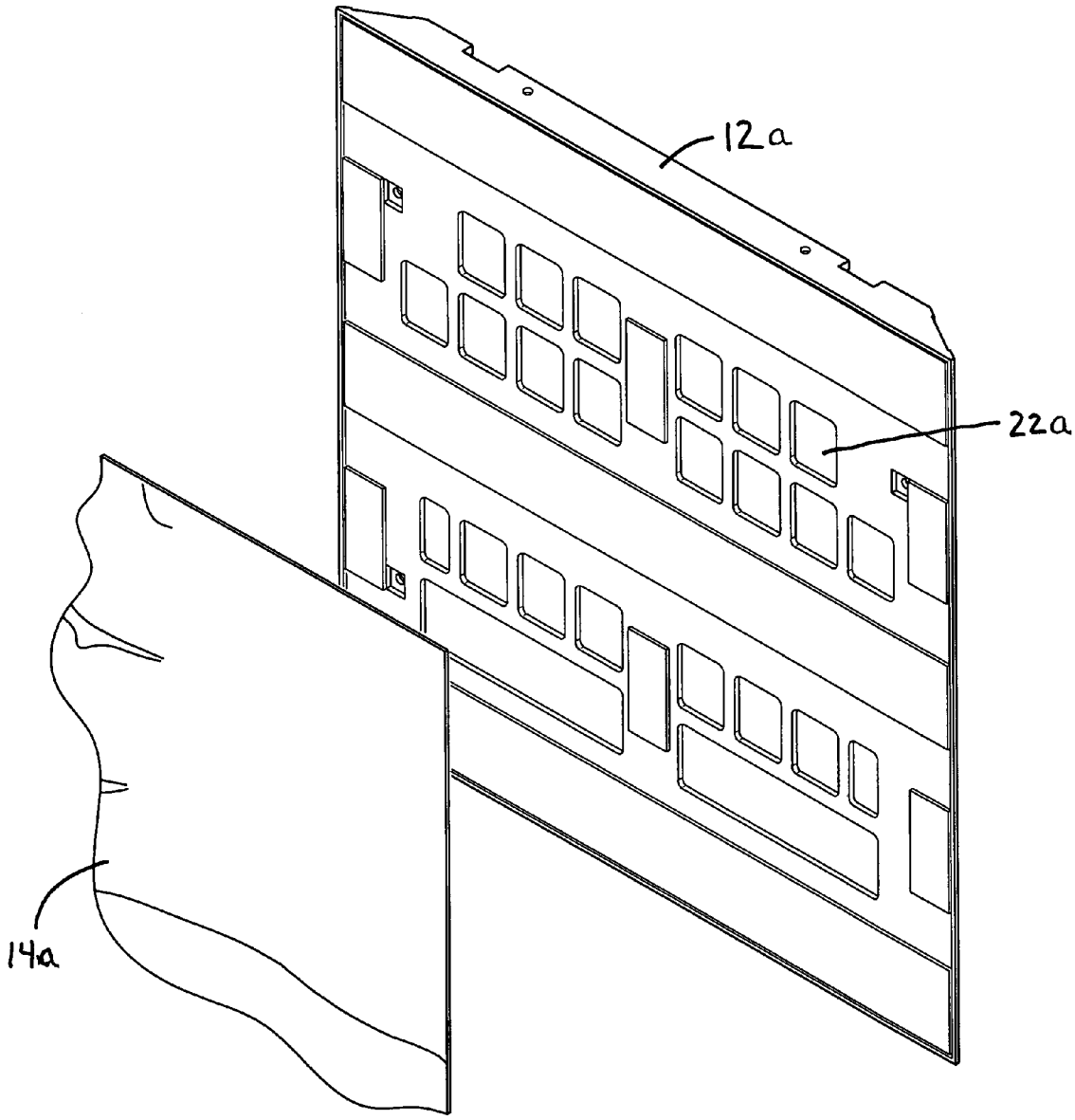
FIG. 10 is a detailed view of a frame of a display system according to an alternative embodiment.
Figure 11:
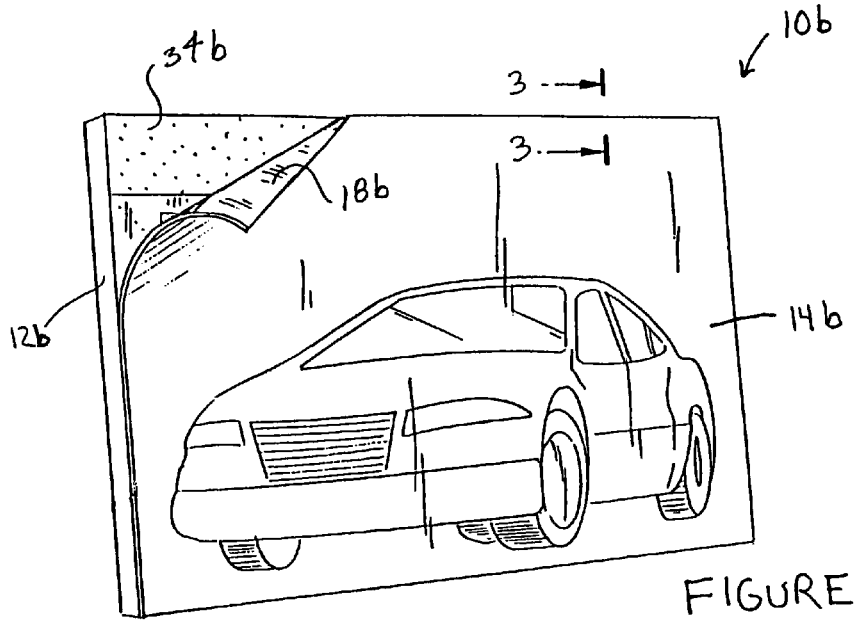
FIG. 11 is a front perspective view of a display system according to an alternative embodiment.
Figure 13:
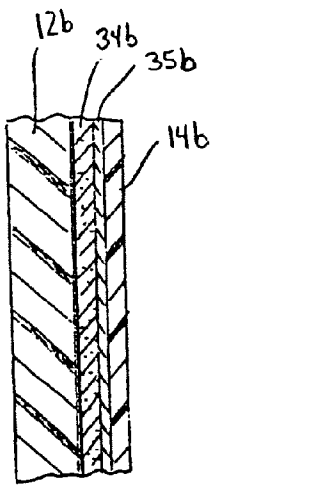
FIG. 13 is a cross-section view of the display system taken along line 3-3 of FIG. 11.

As shown in the FIGURES, the frame may be an "open" frame comprised of several members or portions. As shown in FIGS. 1 through 9C, frame 12 includes a plurality of apertures 22 (e.g., openings, cut-outs, etc.). FIG. 10 shows a frame 12*a* having a plurality of apertures 22*a* and an graphic sheet 14*a* according to an alternative embodiment. FIGS. 11 through 13 show a frame 12*b* having a plurality of apertures 22*b* according to an alternative embodiment. FIG. 14 shows a frame 12*e* having a plurality of apertures 22*e* according to an alternative embodiment. FIGS. 15-18 show a frame 12*c* having a plurality of apertures 22*c* according to an alternative embodiment. Apertures 22, 22*a*, 22*b*, 22*c*, and 22*e* reduce the weight of the frame and reduce the cost of materials for constructing the frame. The apertures create a framework (e.g., slats) that provides a lightweight yet structurally stiff frame that tends to deter bending and deflection of the frame. Vertical members and horizontal members may form the outer boundary (e.g., perimeter) of the frame which acts as the border to align graphic sheets attached to the frames. Vertical members and horizontal members may form an inner support structure such as a cross shape, etc. (e.g., members 26, 28 shown in FIG. 17). Diagonal members may be utilized to provide additional strength (e.g., members 30 shown in FIG. 17). According to an alternative embodiment, the frame may have a variety of structural configurations including having a solid body.

Figure 18:
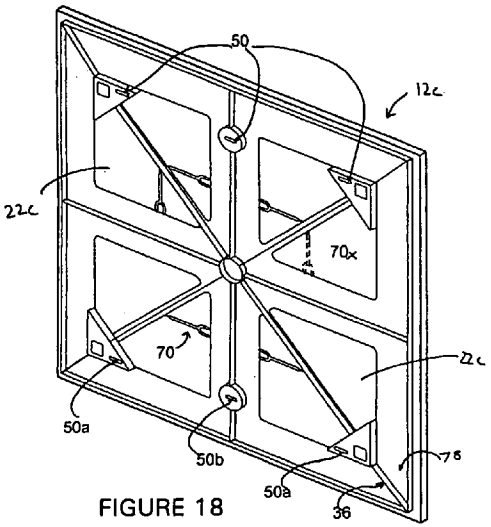
FIG. 18 is a rear perspective view of a frame for use with a display system according to an exemplary embodiment.
Figure 17:
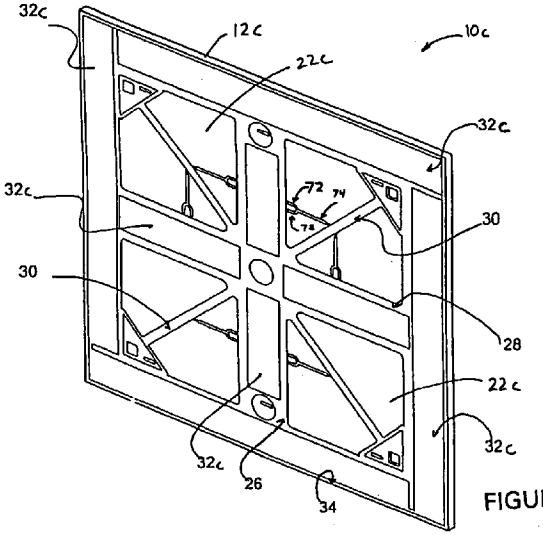
FIG. 17 is a front perspective view of a frame for use with a display system according to an exemplary embodiment.
Figure 19:
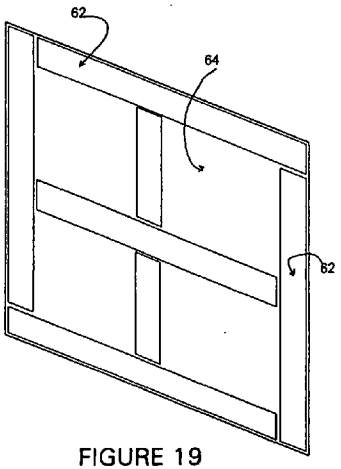
FIG. 19 is a rear perspective view of a panel for use with a display system according to an exemplary embodiment.

According to an exemplary embodiment shown in FIG. 18, frame 12*c* may be configured to attach to a support surface (such as wall 6) via fasteners (such as screws, bolts, adhesives, etc.) provided through apertures 50. According to an exemplary embodiment shown in FIG. 18, six apertures may be provided for mounting frame 12*c* to the wall. Apertures 50*a* may be provided at or near corners of frame 12*c*. Apertures 50*a* may be used in installations onto flat walls. Apertures 50*b* may be provided on a central vertical axis of frame 12*c*. Apertures 50*b* may be used in installations of the frame onto curved walls. According to other exemplary embodiments, any suitable number of apertures may be provided.

Magnets (e.g., magnetic material, magnetic receptive material, magnetic portions, magnetizable portions, etc.) may be provided on any one or more portions of the frame. As shown in FIGS. 1, 2, 4 and 7, magnets 32 are provided on vertical members and horizontal members of frame 12. According to various alternative embodiments, magnets may be provided on various portions, edges, cross-shaped members, diagonal members, other selected areas, or all areas on the frame (see FIGS. 10, 11, 12, 13 and 15 through 25). According to other alternative embodiments, magnets may be provided on a surface, or below a surface of the frame. Magnets may occupy any space and/or cover any surface area sufficient to provide, in part, support for the graphic. Other lips or edges (e.g. edge or border 34 on frame 12*c* shown in FIG. 17) may also provide support for the graphic. Magnets 32 are attached to the frame 12 with an adhesive, fasteners, or another suitable means for attaching. According to an exemplary embodiment, the magnets are 0.045 inch hi-energy magnets having pressure sensitive coating on the back.

As shown in FIGS. 1 through 9C, magnets 32 co-act with the magnetically receptive material on frame 12 to hold the graphic sheet 14 to frame 12. Magnets 32 provide a magnetic surface configured to releasably attach through magnetic attraction to the magnetically receptive material of graphic sheet 14. Magnets 32 are configured to register with and/or contact the magnetic receptive material on graphic sheet 14. According to various alternative embodiments, the magnetic receptive material may be located anywhere on the frame (e.g., rear surface 18) to adequately support the graphic sheet. For example, magnets may be positioned at the top, middle, and bottom of the frame, in alignment with the magnetic receptive material on the graphic sheet, but could be arranged in different patterns to mirror and/or not mirror other arrangements of the magnetic receptive material on the graphic sheet. According to an exemplary embodiment, the magnets are preferably made of and/or comprise barium ferrite, but may be constructed of another suitable magnetic material.

According to an exemplary embodiment shown in FIG. 18, one or more spacers 70 (e.g. shims) may be provided on frame 12*c*. According to an exemplary embodiment, spacers 70 may be molded in during the construction and/or assembly of frame 12*c*. Spacers 70 may be removed or broken off of frame 12*c* for use while installing frame 12*c* onto wall 6 (see FIG. 18, spacer 70*x*). For example, if wall 6 is not flat, or if there would otherwise be gaps between frame 12*c* and wall 6, spacer 70 may be provided between frame 12*c* and wall 6 to fill the space or gap. Spacer 70 may further advantageously assist in preventing breakage or fracture of frame 12*c* while being installed. According to a particularly preferred embodiment, spacer 70 has two prongs 72 and member 74. Prongs 72 may be placed on either side of aperture 50, thereby allowing a fastener to coact with the wall, while still providing a spacer or backer between frame 12*c* and wall 6. Member 74 may advantageously allow an installer to handle or hold spacer 70 while installing a fastener through aperture 50.

Figure 16:
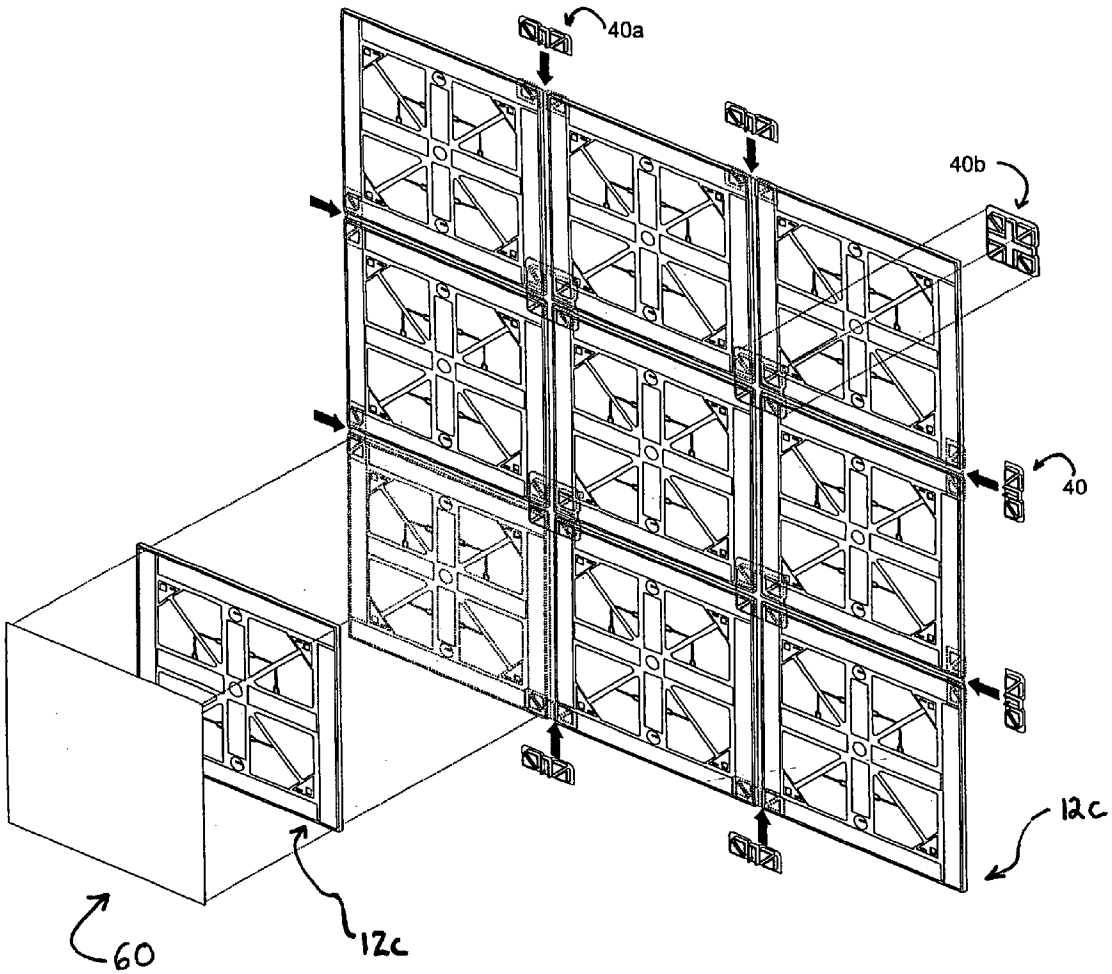
FIG. 16 is an exploded perspective view of a frame provided with magnetic material for use with a display system according to an exemplary embodiment.

As shown in FIG. 16, mounting or linking elements shown as links 40 are provided between adjacent frames. Link or connector 40 may further be configured to link, space, attach couple, interconnect guide, or position adjacent frames. Link may provide relative positioning between adjacent frames. Link may also be configured to provide gaps or spaces between adjacent frames with controllable tolerances. As shown in FIG. 16, link 40 may be configured to attach two adjacent frames (see link 40*a*). Link 40 may also be configured to attach four adjacent frames (see link 40*b*). According to various alternative embodiments, the link may be configured to attach or couple two or three or more adjacent frames. According to exemplary embodiments, the links are not necessarily used.

Figure 21:
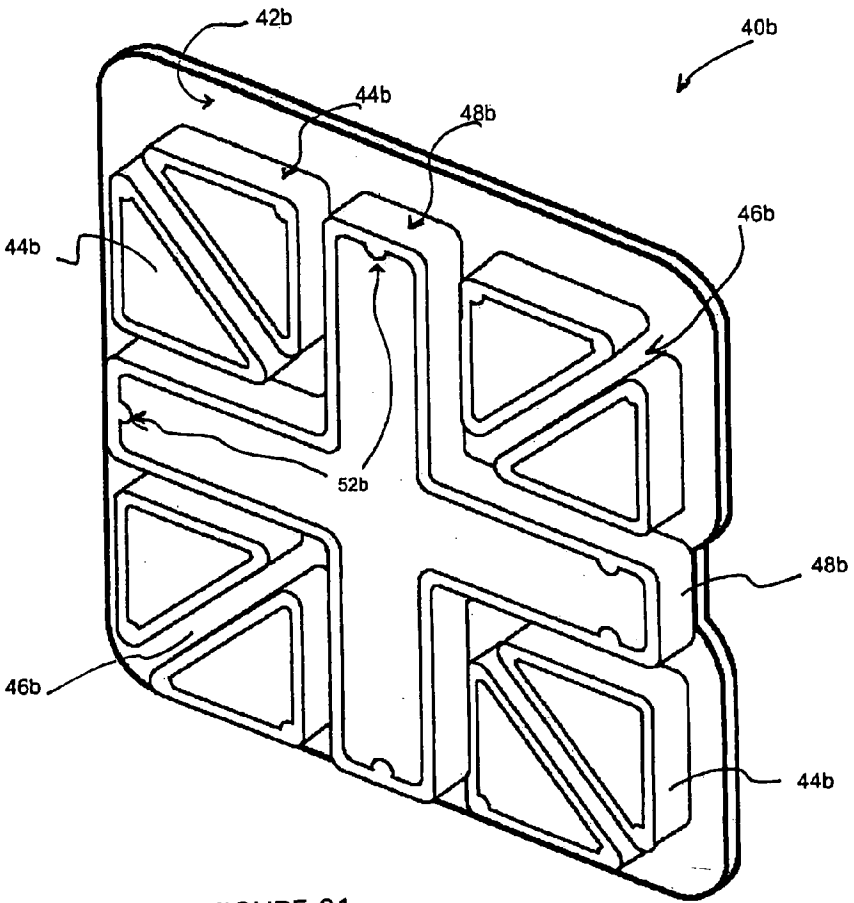
FIG. 21 is a perspective view of a link for use with a display system according to an exemplary embodiment.
Figure 20:
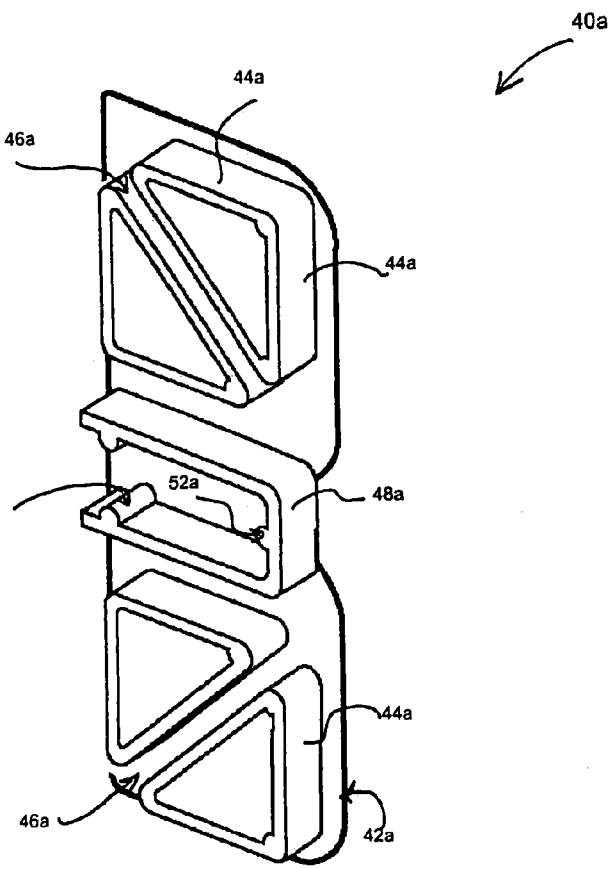
FIG. 20 is a perspective view of a link for use with a display system according to an exemplary embodiment.

As shown in FIGS. 20 and 21, link 40 comprises a base 42, one or more walls 44, one or more slots 46, and one or more spacer portions 48. Walls 44 may be constructed from resilient or flexible material. As shown in FIG. 20, link 40*a* is configured to couple two adjacent frames. Walls 44*a* are provided on base 42*a*. According to a particularly preferred embodiment, walls 44*a* form one or more slots 46*a*. Walls 44*a* and slots 46*a* may comprise a connector portion. For example, walls 44*a* may be configured to be received in a recessed portion on the back of frame 12*c* (see FIG. 18, portion 78). Slot 46*a* is configured to receive a raised portion 36 (or rib) provided on a back side of frame 12*c* (see FIG. 18). Raised portion 36 fits into slot 46*a* to assist in the proper placement and positioning of frame 12*c*. Spacer portion 48*a* is configured to form (and thereby fit between) a gap between two adjacent frames. Spacer portion 48*a* also assists in the proper placement and positioning of frame 12*c*. According to a particularly preferred embodiment, spacer portion 48*a* has a U-shape. The closed end of the U-shape may be installed facing outward in an installed position, thereby providing a "finished" edge. Projections 52*a* may be provided on spacer portion 48*a* for increased strength or rigidity.

As shown in FIG. 21, link 40*b* is configured to couple four adjacent frames. Walls 44*b* are provided on base 42*b*. According to a particularly preferred embodiment, walls 44*b* form one or more slots 46*b*. Slot 46*b* is configured to receive a raised portion 36 provided on a back side of frame 12*c*. Raised portion 36 fits into slot 46*b* to assist in the proper placement and positioning of frame 12*c*. Spacer portion 48*b* is configured to form (and thereby fit between) a gap between the four adjacent frames. Spacer portion 48*b* also assists in the proper placement and positioning of frame 12*c*. According to a particularly preferred embodiment, spacer portion 48*a* has a cross shape. Projections 52*b* may be provided on spacer portion 48*b* for increased strength or rigidity.

According to other alternative embodiments, the link may have a wide variety of shapes and/or configurations which provide for the proper spacing and/or interconnectivity of adjacent frames. According to an exemplary embodiment, the link and frame coact with an interference fit, press fit, via deformation of the walls, etc. According to another alternative embodiment, the spacer portion may be omitted. According to other alternative embodiments, more or fewer projections (e.g., wall portions) may be provided.

Links 40 may be provided as display system 10*c* is constructed and/or assembled. According to a particularly preferred embodiment, a vertical line may be provided on wall 6 as a reference line. A first frame 12*c* may be coupled to wall 6 along the vertical reference line. Links 40 may then be provided in appropriate locations (e.g. corners of frame 12*c*). Additional frames may then be coupled to wall 6, using links 40 for the appropriate spacing and/or placement. As display system 10*c* is assembled by placing frames 12*c* on wall 6, links 40 assist in keeping frames 12*c* in straight lines along wall 6, and ensuring proper placement and alignment of frames 12*c*.

According to an alternative embodiment, the link is configured to be coupled to a wall with one or more fasteners, and the frames are then configured to couple or coact with the link. According to further alternative embodiments, links may be coupled to the wall, and then frames may be provided on the links. According to other alternative embodiment, the link may be configured to be placed along edges and/or corners of the frame.

Link may be constructed and/or assembled from a single body. According to alternative embodiments, the link may be constructed and/or assembled from multiple pieces and/or assemblies. According to a particularly preferred embodiment, links may be constructed and/or assembled from injection molded plastic. According to alternative embodiments, the link may be constructed and/or assembled from a variety of other materials, including polymers, composites, metals, etc.

FIGS. 11 through 14 illustrate display systems according to alternative embodiments. FIGS. 11 through 13 show display system 10*b* having a graphic sheet 14*b* mounted on a frame 12*b*. Rear surface 18*b* of graphic sheet 14*b* includes magnetically receptive material (shown as strips 35*b*) screened onto surface 18*b*. The magnetic attraction between magnets 34*b* and strips 35*b* is sufficient to support the weight of graphic sheet 14*b*. FIG. 14 illustrates an exemplary embodiment of a system 10*e* in which a plurality of adhesive portions 35*e* are mounted to a rear surface 18*e* of a graphic sheet 14*e*, and the magnetic receptive material is silk screened onto adhesive portions 35*e*. Sheet 14*e* may then be attached to magnets 34*e* on frame 12*e*. According to various exemplary embodiments, any amount of magnetic receptive material may be used. For example, fewer portions or more portions may be provided as necessary, the adhesive strips may be arranged in a pattern other than shown (e.g., discrete squares of adhesive material silk screened with magnetic receptive material), or the entire rear surface may be covered with an adhesive strip silk screened with the magnetic receptive material.

As described above, a plurality of frames and graphic images may be used to form an overall composite image. According to an exemplary embodiment shown in FIGS. 15 and 16 display system 10*c* which comprises one or more frames (e.g. a frame system or network, bases, mounting surfaces, mounting structures, support structures, supports etc. shown as frame 12*c*), one or more linking elements or connectors (e.g., fasteners, mounting points, interconnects, brackets, links, etc. shown as link 40), and one or more graphic sheets 60 (e.g., sheets, panels, etc.).

The interaction of the graphic sheets with the frame allows the graphic (and overall graphic) to be easily removed, replaced, added, changed, updated, etc. The removable graphic sheets provide levels of reconfigurability, interchangeability, and replaceability. For example, display systems may be used in automotive dealerships for displaying pictures of cars, car models, advertising, etc. Such graphics often need to be updated due to model changes, developments, etc. The overall graphic may be changed as part of a scheduled update or maintenance or altered in conjunction with special events. Display system 10 provides an advantageous way of allowing easy updates of the graphics. Only replacement graphic sheets need to be printed (on a suitable magnetic graphic sheet such as paper having a magnetized or magnetizable ink) in order to update the visual effect of the wall. The graphic sheets may still be used in the display system.

It should be appreciated that the magnets, magnetic portions, magnetized portions, magnetically receptive materials, etc do not require a certain configuration. These magnetic and/or magnetically receptive materials may be provided in a variety of arrangements, (i.e. a magnet may be placed on the graphic sheet, and magnetically receptive materials may be provided on the frame; two magnets may be provided; a magnetized portion may be placed on the frame, and a magnet on the graphic sheet, etc.).

According to a particularly preferred embodiment, graphic sheets 60 are constructed from eighteen point tagstock which has been varnished on the front sides to assist in preventing warping due to humidity. According to an alternative embodiment, the graphic sheets may be varnished on the back sides. According to various exemplary embodiments, the graphic sheets are a paper product having a magnetized or magentizable ink provided on a back surface. According to various alternative embodiments, graphic sheets may be constructed from tag-stock, photo paper, styrene, film, paper, plastics, ABS plastic, etc.

The frames and/or graphic sheets may be provided with indicia which would aid in the construction of the display system. For example, each graphic sheet may be provided with a reference numeral (e.g. A-1, B-4, etc.) which would be indicative of the relative placement of each graphic sheet in the display system.

The frames may be attached to an existing wall or similar surface using fasteners such as screws, nails, other mechanical fasteners, adhesives or the like. The frames may be laid out for proper orientation on the wall using a template, showing the placement of the frames, or alternatively, the frames may mounted to the wall by lining up the frames with markings provided on the wall (such as level lines, plumb lines, scribed lines, levels, etc.). A series of frames may be mounted to a wall, making a grid type system of frames onto which graphic sheets may be mounted. According to other alternative embodiments, a single graphic sheet may be attached to the support structure, with the links providing support/linking the remaining graphic sheets together.

According to another exemplary embodiment shown in FIGS. 22 through 25 display system 110 comprises one or more frames (shown as frame 120), one or more graphic sheets (shown as graphic sheet 140), and one or more sheets 160 (e.g., panels, graphic sheets similar to graphic sheets 40, etc.).

Figure 22:
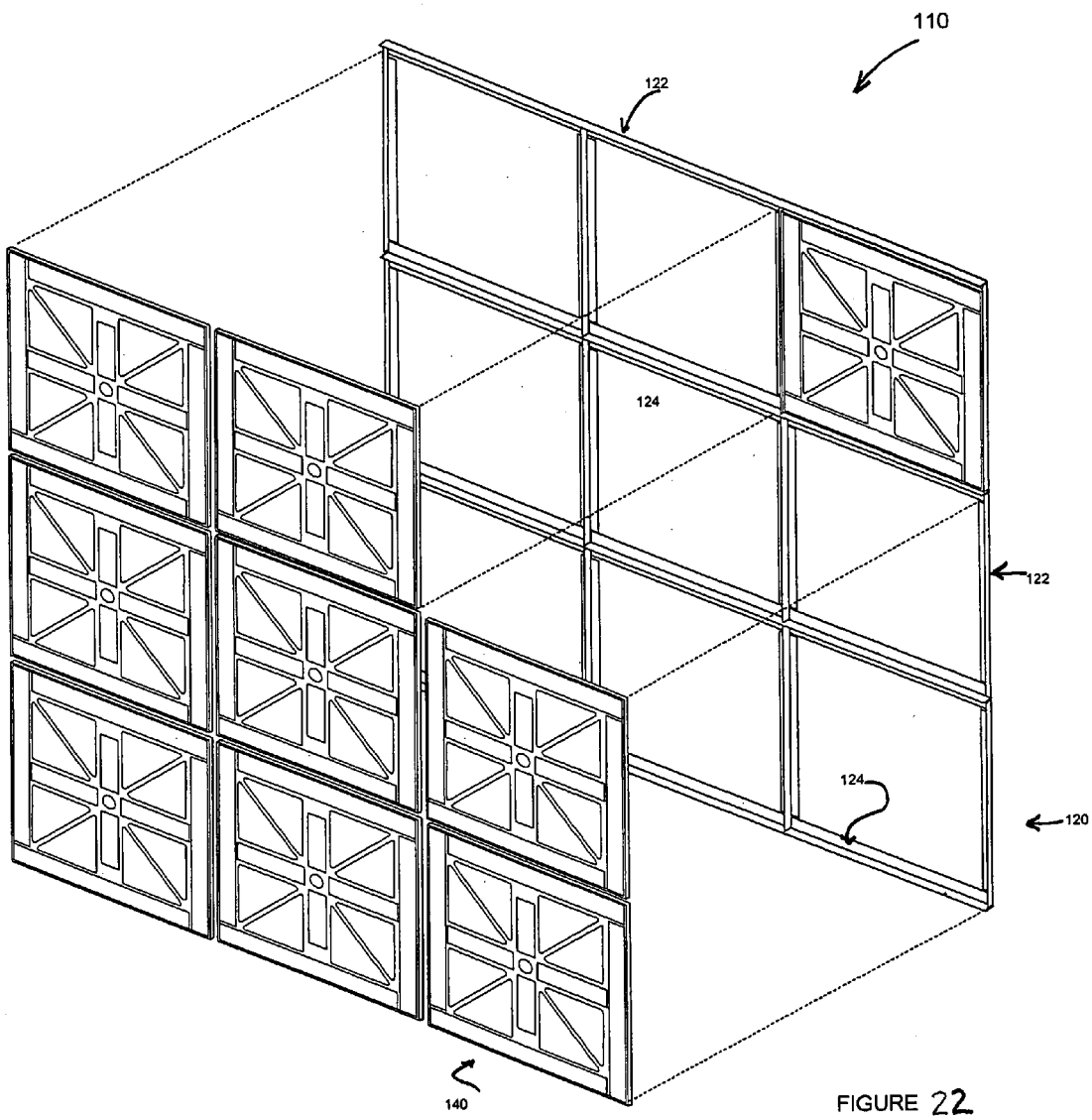
FIG. 22 is a perspective view of a display system according to an alternative embodiment.
Figure 24:
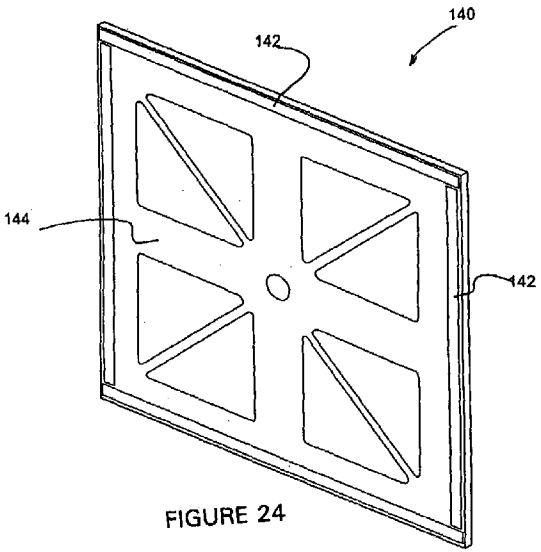
FIG. 24 is a rear perspective view of a frame for use with a display system according to an alternative embodiment.

As shown in FIG. 22, one or more frames 120 (e.g., mounting structures, support structures, grids, frames, supports) may be provided for use with display system 110. Frame 120 may be a series or grid assembly of tracks 122 (e.g. rails, extrusions, etc.). Frames 120 may be constructed from a variety of materials, such as extruded aluminum railings, other metals, metal alloys, plastics, composites, etc.

Tracks 122 may be provided in a grid assembly as shown in FIG. 22. The grid size (i.e., the spacing between adjacent tracks) may be a variety of dimensions, however in a particularly preferred embodiment, the grid size is approximately 2 feet by 2 feet. In an exemplary embodiment, track 122 has a T-shaped cross section, although other shapes may be used.

One or more fasteners 124 may be provided on track 122. According to a particularly preferred embodiment, fastener 124 is a Velcro fastener. According to various alternative embodiments, other coacting elements (e.g., fasteners, attachment mechanisms, Velcro, low bond adhesives, mechanical connectors, clips, magnets, etc.) may be provided on (or within or adjacent to) track 122.

Frames 120 may be mounted to a wall using fasteners (not shown) such as screws, adhesives, bolts, other mechanical fasteners, etc. Frames 120 are laid out in a grid arrangement having vertical and horizontal tracks. The grid arrangement results in a series of individual frames for receiving graphic sheets 140.

Graphic sheets 140 are dimensioned to be received in a corresponding grid opening (i.e. in an exemplary embodiment, approximately 2 feet by 2 feet, although other sizes may also be used). Graphic sheets 140 may be provided with fasteners 142 configured to couple or coact with fasteners 124. Fasteners 142 may be provided on a back surface 144 of graphic sheet 140 (see FIG. 24).

According to a particularly preferred embodiment, fastener 142 may be a Velcro fastener provided along edges of back surface 144 configured to engage with Velcro fasteners 124 provided on frame 120. According to various alternative embodiments, other coacting elements (e.g., fasteners, attachment mechanisms, Velcro, low bond adhesives, mechanical connectors, clips, magnets, etc.) may be provided on (or within or adjacent to) back surface 144. In a preferred embodiment, the fasteners provides a non-permanent attachment between the graphic sheets and frame. A non-permanent attachment is preferable as to allow removal of graphic sheets from the display system, although permanent attachment means may be used.

According to various exemplary embodiments, the graphic sheets may be constructed from plastics, polymers, SINTRA™ material, styrene, vacuum formed plastics, injection molded plastics. An advantageous feature of using plastics is that the material may be provided in a variety of desired or preselected colors. By providing the graphic sheet in the desired color removes processing steps which may have been required for edge treatments. Since the graphic sheet is formed in the desired color, no edge treatments may be required (e.g. additional coloration steps, processing steps, etc.).

Figure 23:
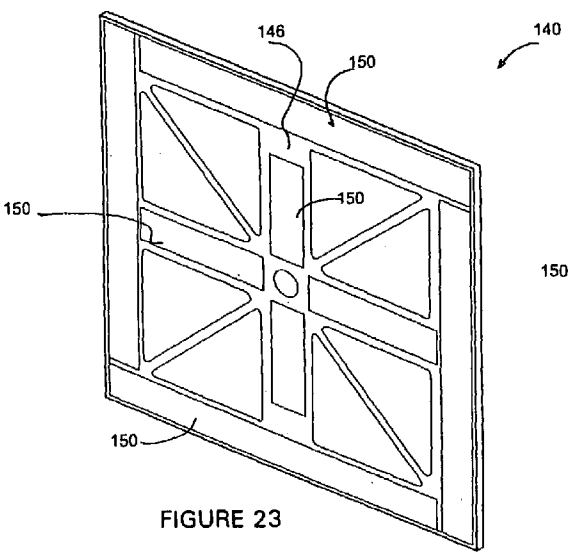
FIG. 23 is a front perspective view of a frame for use with a display system according to an alternative embodiment.

Magnets 150 may be provided on a front surface 146 of graphic sheet 140. Magnets 150 may be provided in a grid pattern as shown in FIG. 23, or in a variety of other configurations, including covering the entire surface of front surface 146.

Figure 25:
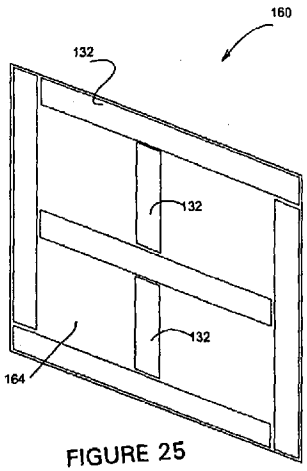
FIG. 25 is a rear perspective view of a panel for use with a display system according to an alternative embodiment.
Figure 28:
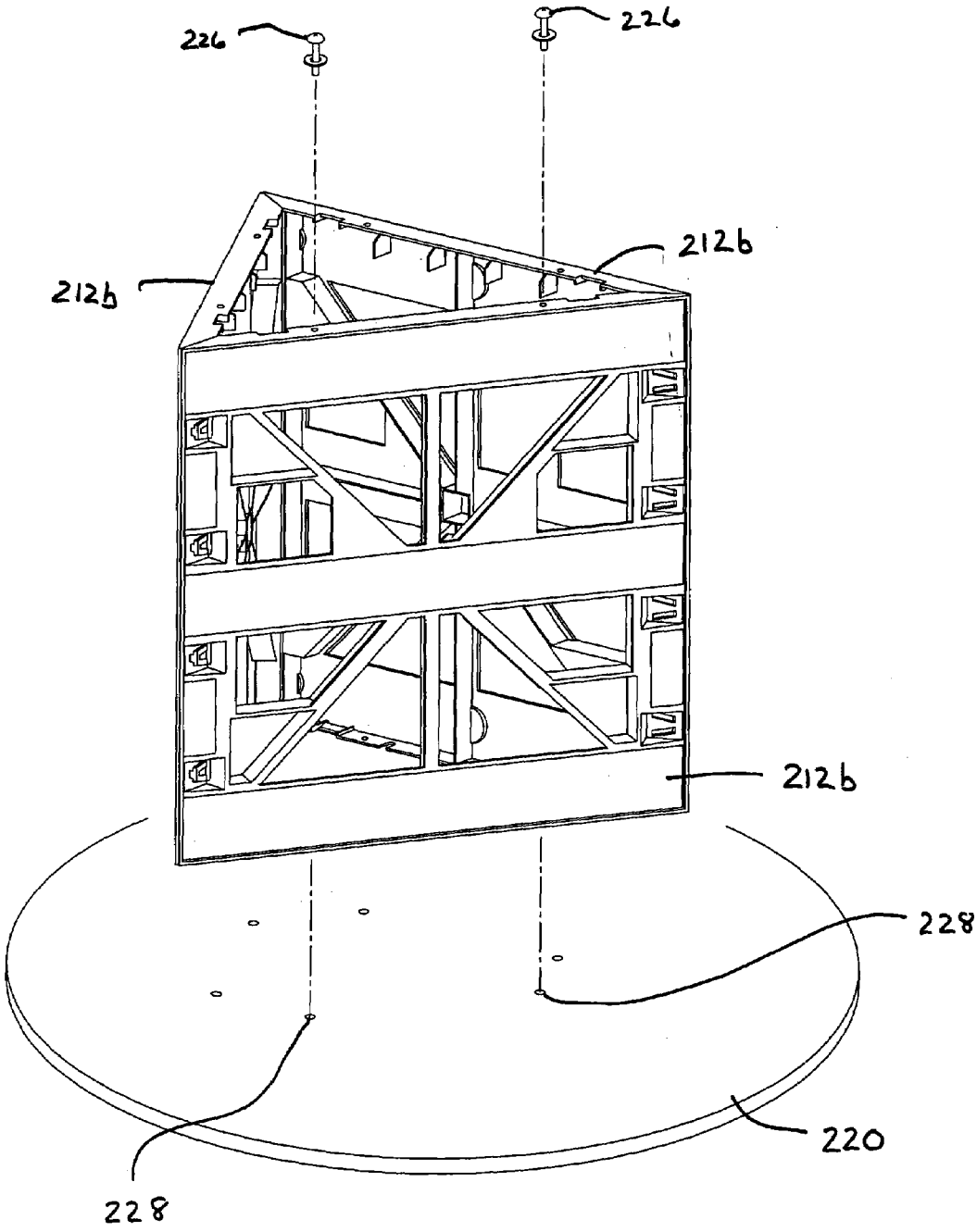
FIG. 28 is a perspective view of a display system according to an exemplary embodiment.

As shown in FIG. 25, one or more sheets 160 may be provided for use with display system 110. Artwork, photographs, pictures, simulated surface finishes, graphics, etc. may be provided on sheets 160. Graphics are provided on or attached to a face of the graphic sheets via graphic images, graphic panels, etc.

As shown in FIG. 25, sheets 160 may also be provided with magnets 132 (e.g., magnetic material, magnetic receptive material, magnetic portions, magnetizable portions, etc.) on a rear surface 164 of sheet 160. According to a particularly preferred embodiment, magnets 132 are a magnetic receptive ink provide in a pattern configured to overlap with magnets 150. According to one particularly preferred embodiment, sheets 160 magnetically couple to graphic sheets 140. Sheets 160 may be constructed from tag-stock, photo paper, styrene, film, paper, plastics, ABS plastic, etc.

The magnetic interaction of the sheets with the graphic sheet allows the graphics (and overall graphic) to be easily removed, replaced, added, changed, updated, etc. For example, display system 110 may be used in automotive dealerships for displaying pictures of cars, car models, advertising, etc. Such graphics often need to be updated due to model changes, developments, etc. The overall graphic may be changed as part of a scheduled update or maintenance or altered in conjunction with special events. Display system 110 provides an advantageous way of allowing easy updates of the graphics. Only new graphic sheets need to be printed (on suitable sheets) in order to update the visual effect of the wall. The graphic sheets may still be used in the display system. There is no need to dispose of the graphic sheet in order to update the graphic.

Display system 110 is advantageously suited to be used in changing over, upgrading or "retrofitting" a previous grid system. For example, a grid system may have a grid similar to that shown in FIG. 22 with a number of Masonite or similar wood-type-product graphic sheets having a visual graphic provided on the graphic sheet (typically printed) fastened to the grid with Velcro fasteners. These graphic sheets may be removed and replaced with graphic sheets 140 and sheets 160. Display system 110 advantageously provides easier changing or updates to the overall graphic. For example, only sheets 160 need to be removed and/or replaced in the event that the overall. Furthermore, sheets 160 may be considerably lighter, easier to store, capable of being folded, rolled, etc., thereby being easier to handle.

Figures 29A, 29B:
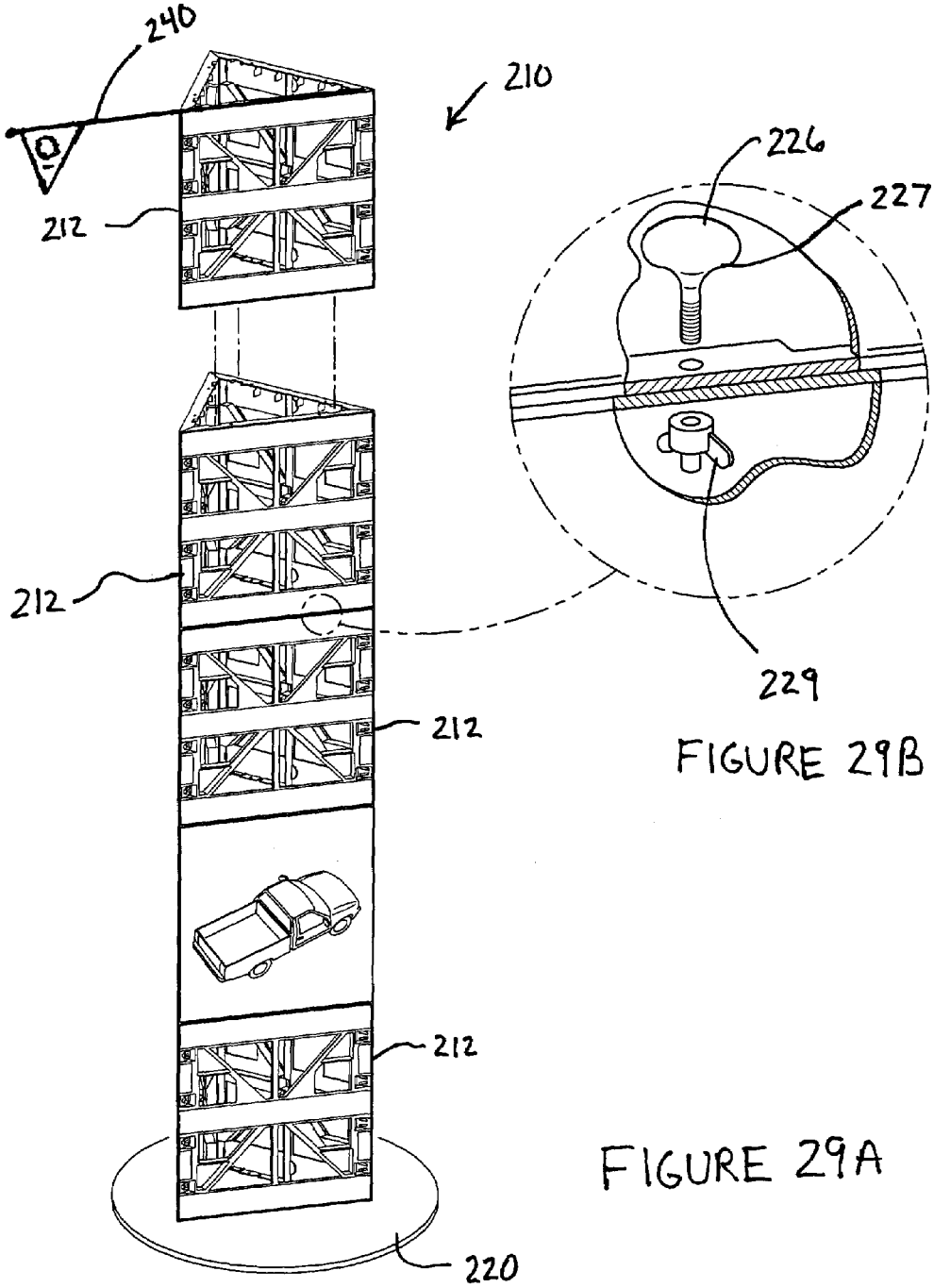
FIG. 29A is a perspective view of a display system according to an exemplary embodiment.
FIG. 29B is a detailed perspective view of the display system of FIG. 29A.

FIGS. 26 through 29B show a display system 200 according to an alternative embodiment. A plurality of frames 212 (e.g., three) are coupled together to form a tower or structure 210 (e.g., system, assembly, pillar, column, fixed structure, triangular assembly, etc.). According to other exemplary embodiments, any number of suitable shapes may be used (e.g., rectangle, pentagon, octagon, tower, etc.). Each of frames 212 are coupled together so that graphic images may be attached to surfaces 216 and be viewable on different sides of system 210. According to an exemplary embodiment, frames 212 are coupled together by snap-fit (e.g., interlocking portion, members, ridges, shown as mechanism 231). Mechanism 231 includes connectors 233 (e.g., grooves, channels, ridges, aligning members, etc.) and indents 234, 235 (e.g., couplers, connectors, guides, rails, etc.) configured to align frames 212 when coupled together. According to an exemplary embodiment, connectors 233 of one of indents 234, 235 fits within connectors 233 of the other of indents 234, 235 to align frames 212. According to alternative embodiments, the frames may be coupled together according to any suitable method (e.g., adhesive, fasteners, sonic welding, etc.). Multiple levels may be used (see FIG. 29A) so that a plurality of images and frames may be stacked vertically (or horizontally) depending on a particular use. As shown in FIGS. 29A and 29B, a fastener 226 is used to couple frames 212 together. Fastener 226 includes a screw 227 and a wing nut 229. According to alternative embodiments, any suitable attachment means may be used. Bottom frames 212*b* may be coupled to a stand 220 or other mount for display of the images according to any suitable method (e.g., adhesives, fasteners, etc.). Stand 220 includes apertures 228 for coupling to bottom frames 212*b*. A projection (shown schematically as arm 240 in FIG. 29A) from which a banner or the like may be suspended may be coupled to the structure according to a suitable configuration. According to an exemplary embodiment, stand 220 may rotate. As described in this disclosure, different images may be attached to the display system to form an overall composite image, the same images may be used, and/or similar images may be used for a common theme. System 200 is configured to present a graphic, visual effect or other information (e.g., text, messages, visual image(s), text/pictorial combinations, etc.) to allow for the presentation and/or display of a graphic on a variety of structures or surfaces such as walls, ceilings, floors, non-vertical or non-horizontal structures, supports, etc.

It is important to note that the above-described embodiments are illustrative only. Although the invention has been described in conjunction with specific embodiments thereof, those skilled in the art will appreciate that numerous modifications are possible without materially departing from the novel teachings and advantages of the subject matter described herein. For example, different shapes for the frames may be used instead of those described herein. In addition, the frames may couple together at different locations or according to different configurations. Further, any suitable number of frames may be used (e.g., one, three, five, etc.). Accordingly, these and all other such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangements of the preferred and other exemplary embodiments without departing from the spirit of the present invention.

What is claimed is:

1. A display system comprising:

a plurality of frames that are configured to form an overall composite design, each frame having a magnetic surface;

a plurality of graphic sheets, each graphic sheet associated with one of the frames, each graphic sheet comprising a substrate having a front surface and a rear surface, wherein a treatment is provided on the front surface and the rear surface; and a spacer integrally formed with one of the plurality of frames, the spacer being configured to be selectively removed from the frame and positioned between the frame and a mounting structure;

wherein the treatment provided on the front surface comprises a graphic image and a film;

wherein the treatment provided on the rear surface comprises a magnetically receptive material comprising an ultra-violet curable compound; and wherein the magnetic surface of each frame is configured to releasably attach through magnetic attraction to the magnetically receptive material of the associated graphic sheet.

2. The system of claim 1, wherein the substrate comprises a cardstock material.

3. The system of claim 2 wherein the film comprises a varnish.

4. The system of claim 1, wherein the spacer further comprises two prongs.

5. The system of claim 1, wherein each frame comprises a plurality of apertures.

6. The system of claim 1, wherein the magnetic surface comprises a plurality of magnetic strips adhered to the frame.

7. The system of claim 6 wherein the magnetically receptive material comprises graphite powder mixed with a carrier.

8. The system of claim 7 wherein the magnetically receptive material is provided on the graphic sheet by curing the ultra-violet curable compound.

9. The system of claim 8 wherein the ultra-violet curable compound is cured using ultra-violet light.

10. The system of claim 9 wherein the magnetically receptive material is provided in ink form.

11. The system of claim 10 wherein the magnetic surface comprises barium ferrite.

12. The system of claim 11 wherein the magnetically receptive material is provided on a substantial portion of the rear surface of each graphic sheet.

13. The system of claim 1 wherein each frame is substantially rigid to substantially deter bending.

14. The system of claim 13 wherein each graphic sheet is substantially flexible and is configured to be rolled up when not in use.

15. The system of claim 1, wherein the treatment applied to the rear surface further comprises a film.

16. The system of claim 1, wherein the plurality of frames are injection molded.

17. A display system, comprising:

a plurality of frames configured to form an overall composite design, each frame having a magnetic surface;

a plurality of graphic sheets, each graphic sheet associated with one of the frames, each graphic sheet comprising a substrate having a front surface and a rear surface;

wherein a graphic image is provided on the front surface and a magnetically receptive material is provided on the rear surface;

at least one spacer attached to one of the frames, the spacer being configured to be selectively removed from the frame and positioned between the frame and a mounting structure; and at least one mounting member configured to couple adjacent frames together and be positioned between the adjacent frames and a mounting structure;

wherein the magnetic surface of each frame is configured to releasably attach through magnetic attraction to the magnetically receptive material of the associated graphic sheet.

18. The system of claim 17, wherein the spacer further comprises two prongs.

19. The system of claim 17, wherein the front surface is further provided with a varnish and the magnetically receptive material comprises an ultra-violet curable compound.

20. The system of claim 17, wherein the plurality of frames are configured to be removably mounted to the mounting structure.

* * * * *